US011128024B2

(12) United States Patent
Goto et al.

(10) Patent No.: US 11,128,024 B2
(45) Date of Patent: Sep. 21, 2021

(54) COMBINER-DIVIDER

(71) Applicant: Hitachi Kokusai Electric Inc., Tokyo (JP)

(72) Inventors: Yusaburo Goto, Tokyo (JP); Keiichi Sakamaki, Tokyo (JP); Yu Wakabayashi, Tokyo (JP)

(73) Assignee: HITACHI KOKUSAI ELECTRIC INC., Tokyo (JP)

( * ) Notice: Subject to any disclaimer, the term of this patent is extended or adjusted under 35 U.S.C. 154(b) by 57 days.

(21) Appl. No.: 16/480,341

(22) PCT Filed: Jan. 30, 2017

(86) PCT No.: PCT/JP2017/003213
§ 371 (c)(1),
(2) Date: Jul. 24, 2019

(87) PCT Pub. No.: WO2018/138919
PCT Pub. Date: Aug. 2, 2018

(65) Prior Publication Data

US 2019/0379100 A1 Dec. 12, 2019

(51) Int. Cl.
*H01P 5/19* (2006.01)
*H01P 1/26* (2006.01)
*H01P 1/36* (2006.01)

(52) U.S. Cl.
CPC ..... *H01P 5/19* (2013.01); *H01P 1/26* (2013.01); *H01P 1/36* (2013.01)

(58) Field of Classification Search
CPC ..... H01P 5/19; H01P 1/26; H01P 1/36; H01P 5/16
See application file for complete search history.

(56) References Cited

U.S. PATENT DOCUMENTS 4,367,445 A 1/1983 Dydyk
5,121,090 A * 6/1992 Garuts ..... H01P 5/10 333/124

(Continued)

FOREIGN PATENT DOCUMENTS

JP 59-8324 Y2 3/1984
JP 59-15057 Y2 5/1984

(Continued)

OTHER PUBLICATIONS

International Search Report of PCT/JP2017/003213 dated Mar. 21, 2017.

*Primary Examiner* — Robert J Pascal
*Assistant Examiner* — Kimberly E Glenn
(74) *Attorney, Agent, or Firm* — Mattingly & Malur, PC

(57) ABSTRACT

A combiner-divider includes a first impedance converter disposed between the first port and the second port, a second impedance converter disposed between the first port and the third port, and an isolation unit disposed between the second port and the third port. The isolation unit includes a balun formed of a first semi-rigid cable and a second semi-rigid cable, and terminating resistors. Each line length of the first impedance converter, the second impedance converter, and the third impedance converter corresponds to ¼ wavelength at a center frequency. A relationship of each impedance Ri of the second port and the third port, an impedance Ro of the first port, and each impedance W of the first impedance converter and the second impedance converters is expressed by $W=(2\times Ri\times Ro)^{1/2}$.

8 Claims, 24 Drawing Sheets

$W=(2RiRo)^{1/2}$
$I=(BT/2)^{1/2}$

(56) References Cited

U.S. PATENT DOCUMENTS

| | | | | |
|---|---|---|---|---|
| 6,529,099 | B1 | 3/2003 | Takenaka | |
| 7,468,640 | B2 * | 12/2008 | Nosaka | H01P 5/10 333/25 |

FOREIGN PATENT DOCUMENTS

| | | | |
|---|---|---|---|
| JP | 2001-36310 | A | 2/2001 |
| JP | 2001-148609 | A | 5/2001 |
| WO | 2016/151726 | A1 | 9/2016 |

* cited by examiner $W=(2RiRo)^{1/2}$
$R=2Ri$ $W = (2RiRo)^{1/2}$
$I = (BT/2)^{1/2}$ $W=(2RiRo)^{1/2}$
$B/2=T$ $W = (2RiRo)^{1/2}$
$I = (BTN/2)^{1/2}$ $W=(2RiRo)^{1/2}$
$B/2=T/N$ $W=(2RiRo)^{1/2}$
$I=(BT/2N)^{1/2}$

COMBINER-DIVIDER

TECHNICAL FIELD

The disclosure relates to a combiner-divider, which is applicable to one provided with a balun, for example.

BACKGROUND ART

The combiner or divider provided with the balun (Balance-Unbalance converter) is used for combine or divide in high frequency power amplification of microwaves. The combiner may serve as the divider by switching functions between the input terminal and the output terminal. Accordingly, both the "combiner" and the "divider" will be hereinafter referred to as a "combiner-divider".

CITATION LIST

Patent Literature

PTL 1: International Publication No. WO 2016151726
PTL 2: Japanese Patent Laid-Open No. 2001-36310

SUMMARY OF INVENTION

Technical Problem

It is a task of the disclosure to provide technology adapted to the combiner-divider provided with the balun.

Solution to Problem

An outline of the representative structure of the disclosure will be briefly described as below.

Specifically, the combiner-divider includes a first port, a second port, a third port, a first impedance converter disposed between the first port and the second port, a second impedance converter disposed between the first port and the third port, and an isolation unit disposed between the second port and the third port. The isolation unit includes a balun formed of a first semi-rigid cable and a second semi-rigid cable, and terminating resistors. Each one end of the terminating resistors is connected to the balun, and each of the other ends of the terminating resistors is grounded. Each line length of the first impedance converter, the second impedance converter, and the third impedance converter corresponds to ¼ wavelength at a center frequency. A relationship of each impedance Ri of the second port and the third port, an impedance Ro of the first port, and each impedance W of the first impedance converter and the second impedance converter is expressed by $W=(2\times Ri\times Ro)^{1/2}$.

ADVANTAGEOUS EFFECTS OF INVENTION

The above-described high power combiner-divider allows reduction in characteristic degradation.

DESCRIPTION OF EMBODIMENTS

Figure 1:
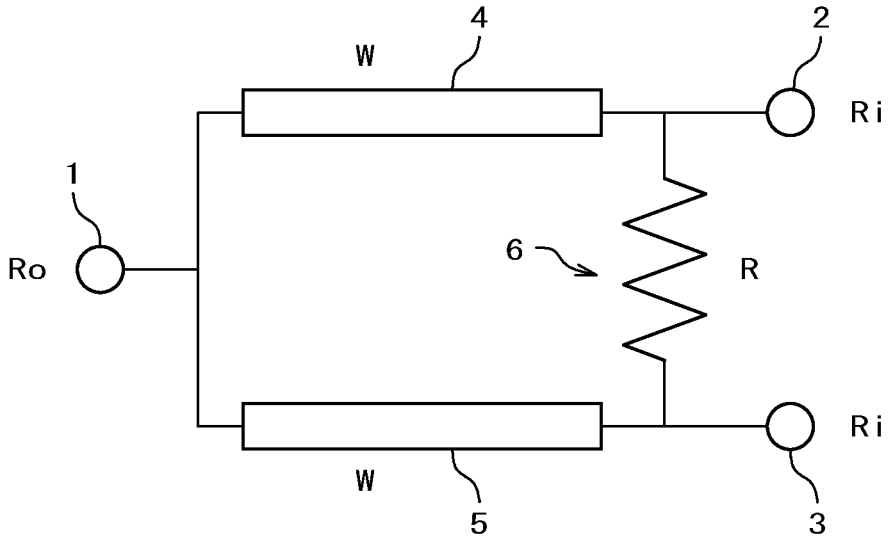
FIG. 1 is a view showing a structure of a Wilkinson type combiner according to Comparative example 1.

An explanation will be made with respect to embodiments, examples, and modified examples referring to the drawings. In the explanation, the same components will be designated with the same codes, and repetitive explanations thereof, thus will be omitted.

Embodiment 1

Comparative Example 1

Figure 2:
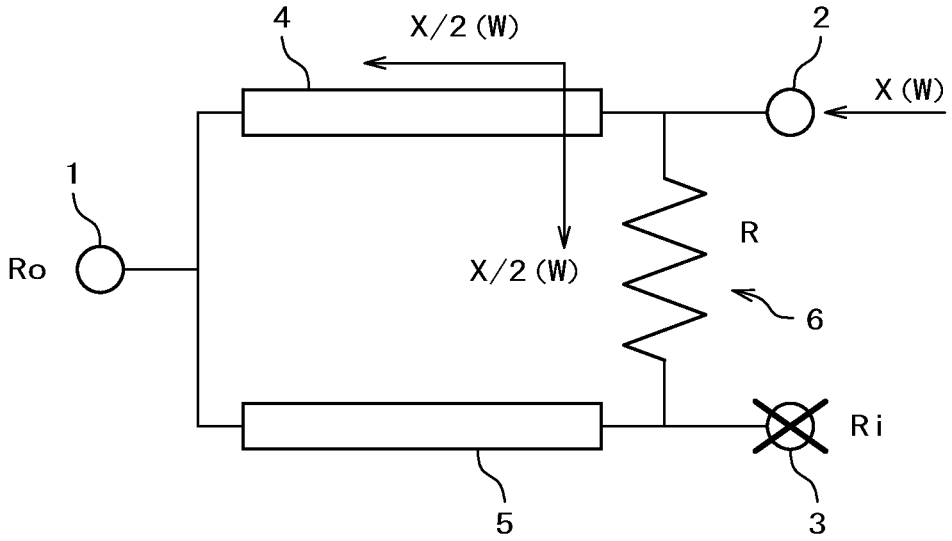
FIG. 2 is a view indicating the state that the power absorbed by an isolation resistor of the Wilkinson type combiner as shown in FIG. 1 is maximized.

The combiner-divider of Wilkinson type has been known. An explanation will be made with respect to the Wilkinson type combiner in reference to FIGS. 1, 2, derived from the technology (Comparative example 1) which has been examined by the inventors preceding application of the present invention. FIG. 1 is a block diagram showing a structure of the Wilkinson type combiner according to Modified example 1. FIG. 2 is a view indicating the state that the power absorbed by an isolation resistor of the Wilkinson type combiner as shown in FIG. 1 is maximized.

The Wilkinson type combiner includes a first impedance converter 4 between a first port 1 and a second port 2, a second impedance converter 5 between the first port 1 and a third port 3, and an isolation resistor 6 between the second port 2 and the third port 3. The first port 1 is an output port, and the second port 2 and the third port 3 are input ports.

Referring to FIG. 1, assuming that each impedance of input terminals of the second port 2 and the third port 3 is designated as Ri, an impedance of an output terminal of the first port 1 is designated as Ro, and the center frequency is designated as fc, each impedance (W) of the first impedance converter 4 and the second impedance converter 5, and an impedance (R) of the isolation resistor 6 may be expressed by the following formulae (1) and (2), respectively:

$$W=(2RiRo)^{1/2} \tag{1}$$

$$R=2Ri \tag{2}$$

where each line length of the impedance converters 4, 5 corresponds to ¼ of the single wavelength (λ) at the fc (λ.4).

The isolation resistor 6 serves to isolate the input ports (second port 2 and third port 3) from each other as well as absorb a combining loss caused by an unbalanced state of amplitude or phase of the input power.

If the input at any one of the input ports becomes OFF, the combining loss to be absorbed by the isolation resistor 6 is maximized.

Referring to FIG. 2, the power X (W) is input to the second port 2 (first input port), and the third port 3 (second input port) is in OFF state. In this case, a half of the input power (X/2 (W)) is output from the first port 1 (output port), and another half (X/2 (W)) will be absorbed by the isolation resistor 6 as the combining loss.

As described above, the maximum of ½ of the input power will be absorbed by the isolation resistor 6. The rated power of the isolation resistor 6 has to be increased to cope with the power increase for the combiner. For example, if power of 100 W is input to the second port 2, and no power is input to the third port 3, the isolation resistor will absorb power of 50 W.

In this case, a parasitic component of the isolation resistor 6 may be a potentially problematic part. Specifically, the increase in the rated power of the isolation resistor 6 enlarges the parasitic component, which disables the function of the isolation resistor 6 at a high frequency.

Referring to FIGS. 3A, 3B, 4A, 4B, 5A, 5B, an explanation will be made with respect to characteristics obtained as a result of optimizing each impedance of the input terminals of the second port 2 and the third port 3, and the impedance of the output terminal of the first port 1 to 50Ω at the center frequency of 1 GHz. Each line length of the impedance converters 4, 5 is adjusted to λ/4 at the fc−1 GHz. Since Ri−Ro−50Ω, the formula (1) results in $W=(2\times50\times50)^{1/2}\approx70.7\Omega$, and the formula (2) results in $R=2\times50=100\Omega$.

Figure 3A:
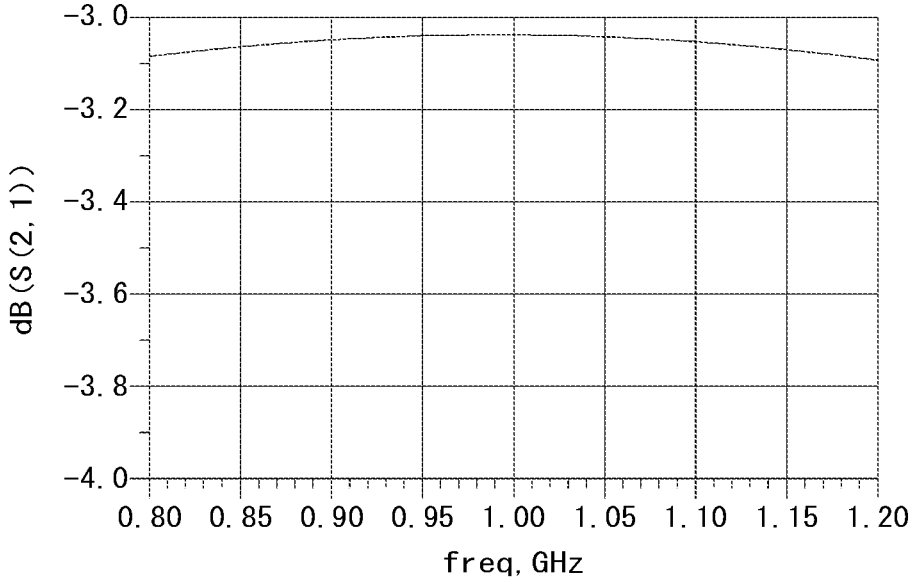
FIG. 3A is a view showing a result of simulating transmission characteristics (when using an ideal resistor for the isolation resistor) of the Wilkinson type combiner as shown in FIG. 1.
Figure 3B:
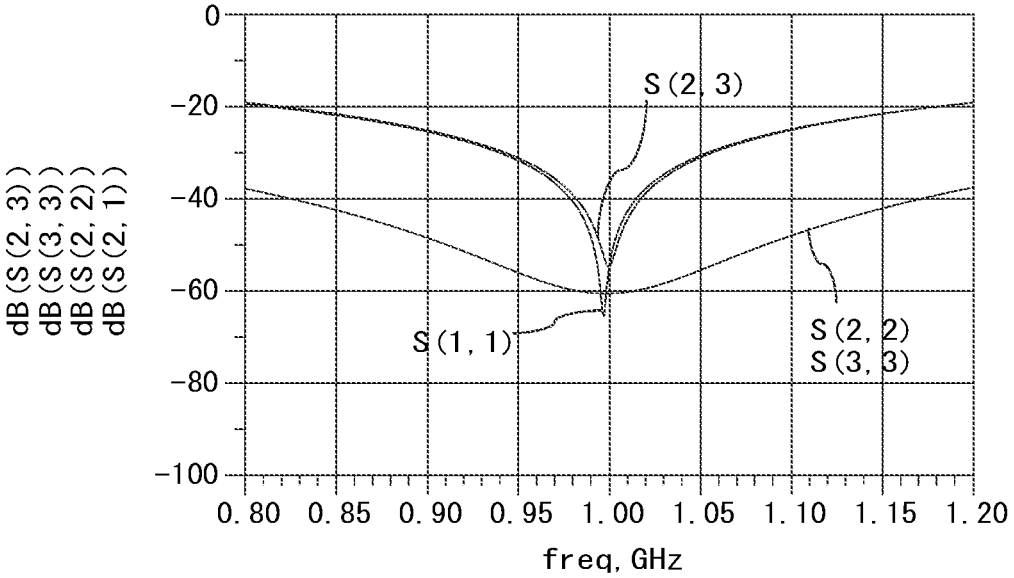
FIG. 3B is a view showing a result of simulating reflection characteristics and isolation characteristics (when using the ideal resistor for the isolation resistor) of the Wilkinson type combiner as shown in FIG. 1.
Figure 4A:
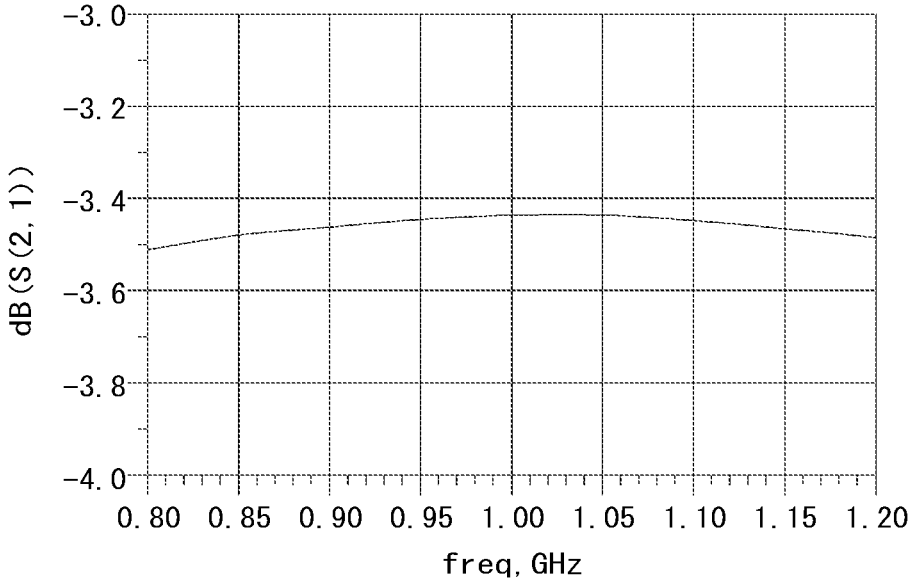
FIG. 4A is a view showing a result of simulating transmission characteristics (when using a resistor with low rated power for the isolation resistor) of the Wilkinson type combiner as shown in FIG. 1.
Figure 4B:
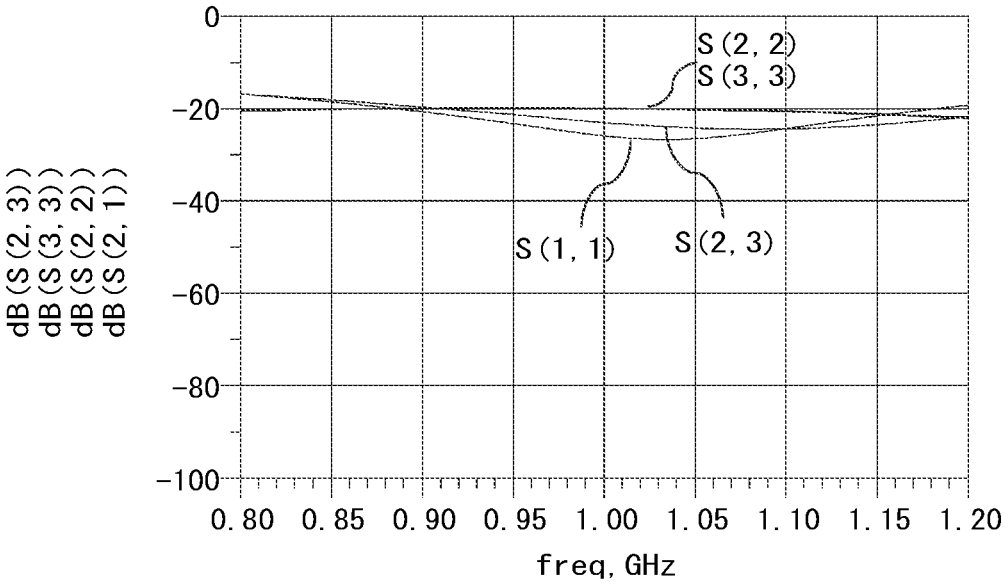
FIG. 4B is a view showing a result of simulating reflection characteristics and isolation characteristics (when using the resistor with low rated power for the isolation resistor) of the Wilkinson type combiner as shown in FIG. 1.
Figure 5A:
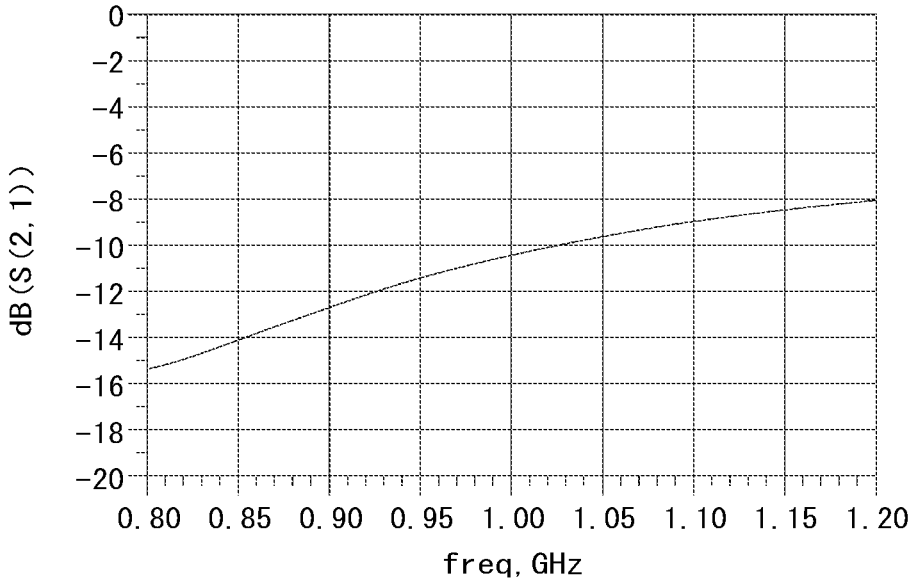
FIG. 5A is a view showing a result of simulating transmission characteristics (when using the resistor with high rated power for the isolation resistor) of the Wilkinson type combiner as shown in FIG. 1.
Figure 5B:
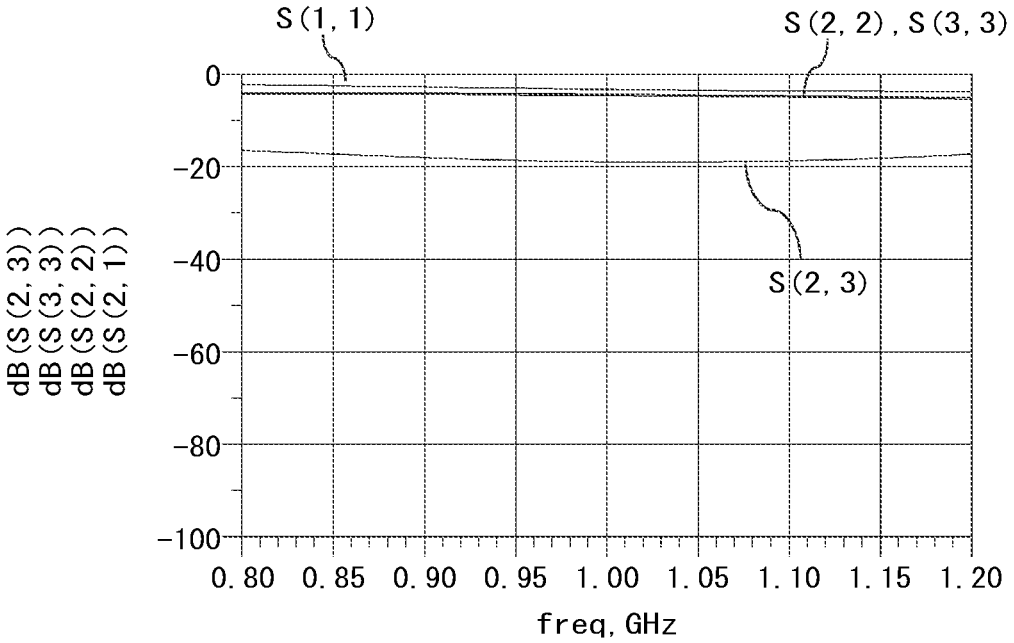
FIG. 5B is a view showing a result of simulating reflection characteristics and isolation characteristics (when using the resistor with high rated power for the isolation resistor) of the Wilkinson type combiner as shown in FIG. 1.

FIG. 3A is a view showing a result of simulating transmission characteristics obtained when using an ideal resistor for the isolation resistor. FIG. 3B is a view showing a result of simulating reflection characteristics and isolation characteristics obtained when using the ideal resistor for the isolation resistor. FIG. 4A is a view showing a result of simulating transmission characteristics obtained when using the resistor with low rated power for the isolation resistor. FIG. 4B is a view showing a result of simulating reflection characteristics and isolation characteristics obtained when using the resistor with low rated power for the isolation resistor. FIG. 5A is a view showing a result of simulating transmission characteristics obtained when using the resistor with high rated power for the isolation resistor. FIG. 5B is a view showing a result of simulating reflection characteristics and isolation characteristics obtained when using the resistor with high rated power for the isolation resistor. FIGS. 3A, 4A, 5A show the transmission loss (S(2,1)) between the second port 2 and the first port 1. Since the relationship between the third port 3 and the first port 1 is analogous to the one as described above in view of the circuit, while having theoretical consistency, the view showing the simulation result omits the transmission loss (S(3,1)) between the third port 3 and the first port as well as the explanation thereof. This applies to FIGS. 7A, 8A, 8B, 10A, 10C, 12A, 12C, 14A, 14C, 17A, 17C, 19A, 19C.

The use of the ideal resistor for the isolation resistor 6 provides satisfactory values of the transmission characteristics, the reflection characteristics, and the isolation characteristics as shown in FIGS. 3A, 3B.

The transmission loss (S(2,1)) between the second port 2 and the first port 1 is in the range approximately from −3.0 to −3.1 dB. The smaller the absolute value of the S(2,1) becomes, the better the characteristics become.

The reflection loss (S(1,1)) of the first port 1 is in the range approximately from −20 to −55 dB. The reflection loss (S(2,2)) of the second port 2 is in the range approximately from −40 to −60 dB. The reflection loss (S(3,3)) of the third port 3 is in the range approximately from −40 to −60 dB. The larger the respective absolute values of the S(1,1), S(2,2), S(3,3) become, the better the characteristics become.

The isolation (S(2,3)) between the second port 2 and the third port 3 is in the range approximately from −20 to −55 dB. The larger the absolute value of the S(2,3) becomes, the better the characteristics become.

If the resistor with low rated power is used for the isolation resistor 6, the transmission loss is increased compared with the case of using the ideal resistor as shown in FIGS. 4A, 4B, leading to degradation both in the reflection characteristics and the isolation characteristics. The S(2,1) is in the range approximately from −3.4 to −3.5 dB. The S(1,1) is in the range approximately from −15 to −25 dB. The S(2,2) is approximately −20 dB. The S(3,3) is approximately −20 dB. The S(2,3) is in the range approximately from −15 to −25 dB.

If the resistor with high rated power is used for the isolation resistor 6, the resultant characteristic degradation is so large that it can be no longer called the combiner. The S(2,1) is in the range approximately from −8 to −15 dB. The S(1,1) is in the range approximately from −2 to −3.5 dB. The S(2,2) is in the range approximately from −4 to −5 dB. The S(3,3) is in the range approximately from −4 to −5 dB. The S(2,3) is in the range approximately from −16 to −19 dB.

Referring to FIGS. 5A, 5B, the parasitic component of the isolation resistor 6 may adversely influence the characteristics to a high degree as the rated power becomes higher, making it difficult to provide the high power Wilkinson type combiner. The above-described degradation may occur in the divider as well as the combiner. The isolation resistor with high rated power adversely influences the characteristics, thus making it difficult to provide the high power Wilkinson type divider.

Example 1

Figure 6:
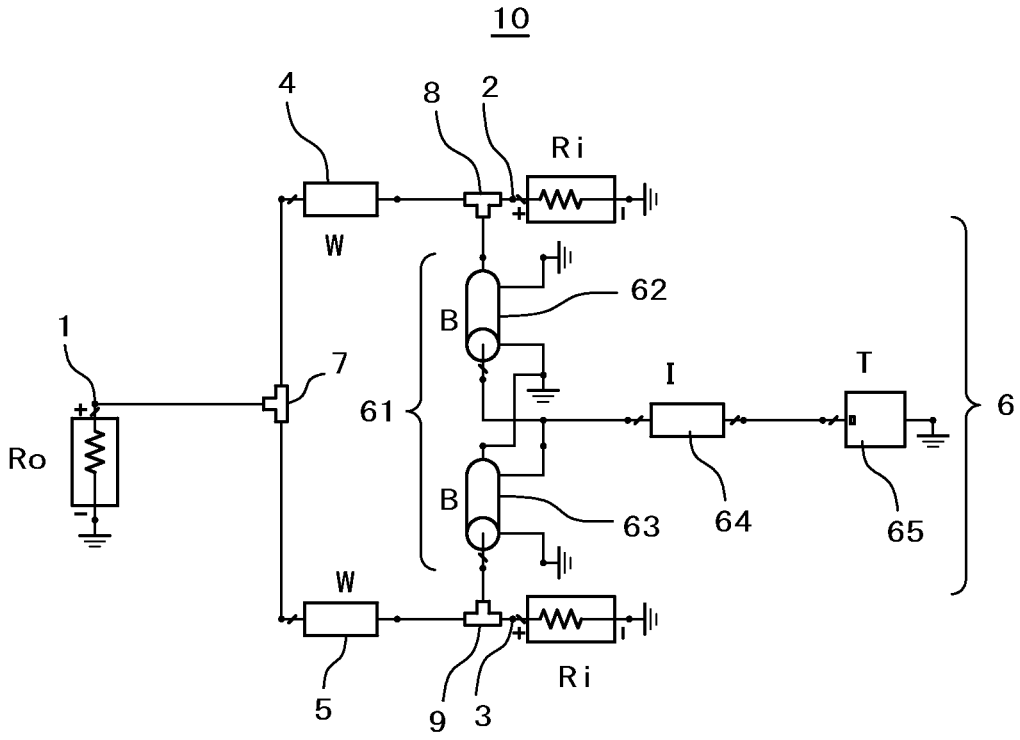
FIG. 6 is a view showing a structure of a Wilkinson type combiner according to an example.

A Wilkinson type combiner according to Example 1 will be described referring to FIGS. 6, 7A, 7B, 8A, 8B. FIG. 6 is a view showing a structure of the Wilkinson type combiner according to Example 1.

As FIG. 6 shows, a Wilkinson type combiner 10 has a combiner 7, an impedance converter 4, a brancher 8 which are disposed between the first port 1 and the second port 2, the combiner 7, an impedance converter 5, a brancher 9 which are disposed between the first port 1 and the third port 3, and the isolation resistor 6 disposed between the second port 2 and the third port 3. The first port 1 is the output port, and the second port 2 and the third port 3 are the input ports.

Assuming that each impedance of the input terminals of the second port 2 and the third port 3 is designated as Ri, an impedance of the output terminals of the first port 1 is designated as Ro, and the center frequency is designated as fc, each impedance (W) of the impedance converters 4, 5 may be obtained by the above-described formula (1).

The isolation resistor 6 of the Wilkinson type combiner 10 includes a balun 61, an impedance converter 64, and a terminating resistor 65. The balun 61 is constituted by semi-rigid cables 62, 63. Each of the semi-rigid cables 62, 63 is a coaxial line having an external conductor made of a copper pipe, a nickel pipe, a stainless steel pipe, and the like. The cable is easily bent into the shape to be finally used, while having its shape retained even after bending. One end of an internal conductor of the semi-rigid cable 62 is connected to the second port 2, and the other end is connected to one end of the external conductor of the semi-rigid cable 63. The external conductor of the semi-rigid cable 62 is grounded. One end of the internal conductor of the semi-rigid cable 63 is grounded, and the other end is connected to the third port 3. The other end of the external conductor of the semi-rigid cable 63 is grounded. The other end of the internal conductor of the semi-rigid cable 62 is connected to one end of the impedance converter 64. The other end of the impedance converter 64 is connected to one end of the terminating resistor 65 while having the other end being grounded.

Assuming that each impedance of the semi-rigid cables 62, 63 is designated as B, an impedance of the terminating resistor 65 is designated as T, and an impedance of the impedance converter 64 is designated as I, the value of the impedance I may be obtained by the following formula (3).

$$I=(BT2)^{1/2} \tag{3}$$

Each line length of the semi-rigid cables 62, 63, and the impedance converter 65 is adjusted to be ¼ of the single wavelength (λ) at the fc (λ/4).

Figure 7A:
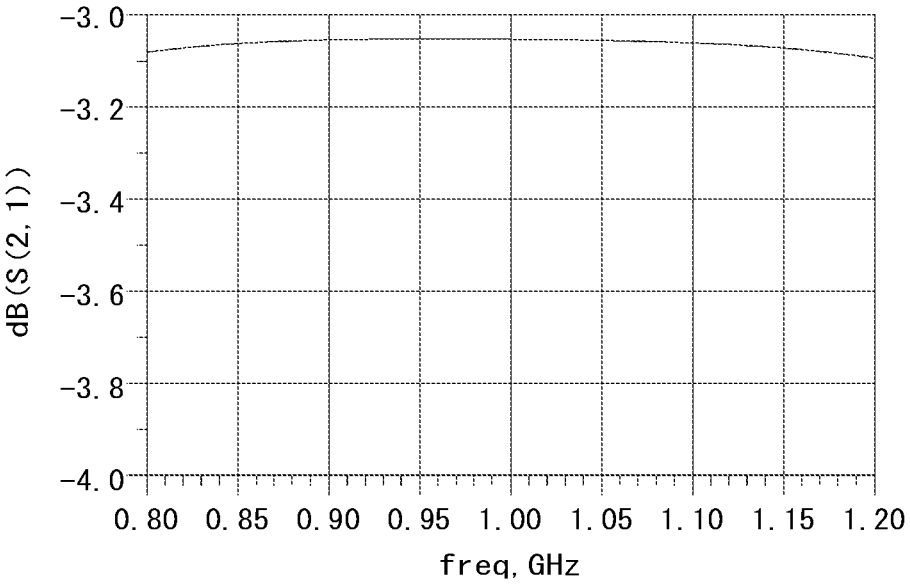
FIG. 7A is a view showing a result of simulating transmission characteristics of the Wilkinson type combiner as shown in FIG. 6.
Figure 7B:
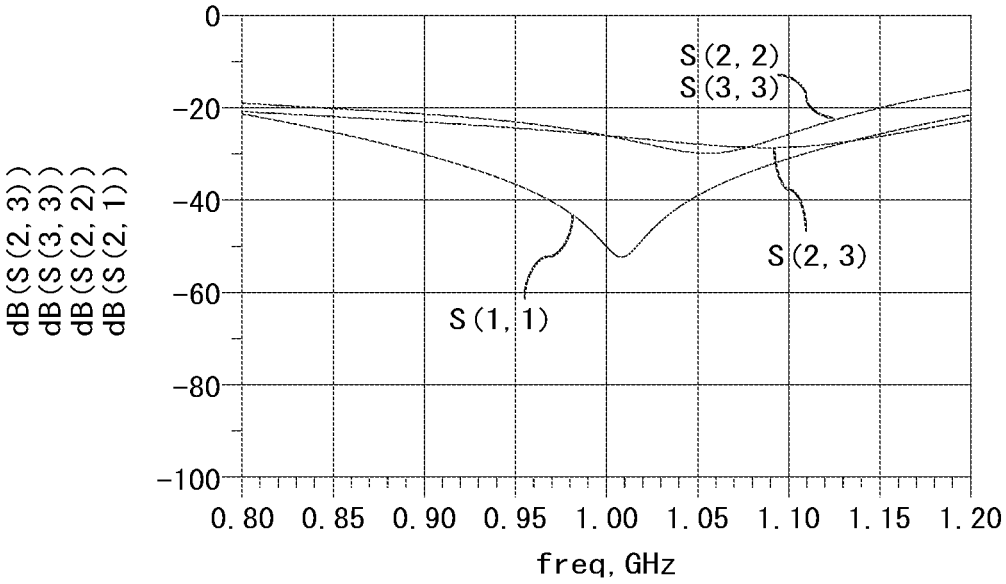
FIG. 7B is a view showing a result of simulating reflection characteristics and isolation characteristics of the Wilkinson type combiner as shown in FIG. 6.

Characteristics of the Wilkinson type combiner 10 as shown in FIG. 6 will be described referring to FIGS. 7A, 7B. FIG. 7A is a view showing a result of simulating transmission characteristics of the Wilkinson type combiner as shown in FIG. 6. FIG. 7B is a view showing a result of simulating reflection characteristics and isolation characteristics of the Wilkinson type combiner as shown in FIG. 6.

The Wilkinson type combiner 10 is subjected to simulation under the conditions of Ro=50Ω, Ri=50Ω, W=70.7Ω, B=50Ω, T=50Ω, I=35.35Ω, and fc=1 GHz. The terminating resistor 65 with high rated power is employed.

As FIGS. 7A, 7B show, characteristics of the Wilkinson type combiner 10 are as good as those in the case using the ideal resistor as shown in FIGS. 4A, 4B. The S(2,1) is approximately −3.1 dB. The S(1,1) is in the range approximately from −20 to −50 dB. The S(2,2) is in the range approximately from −20 to −30 dB. The S(3,3) is in the range approximately from −20 to −30 dB. The S(2,3) is in the range approximately from −20 to −30 dB.

The Wilkinson type combiner with the structure according to Example 1 (FIG. 6) is allowed to be highly powered, which has hardly been practicable ever before.

Figure 8A:
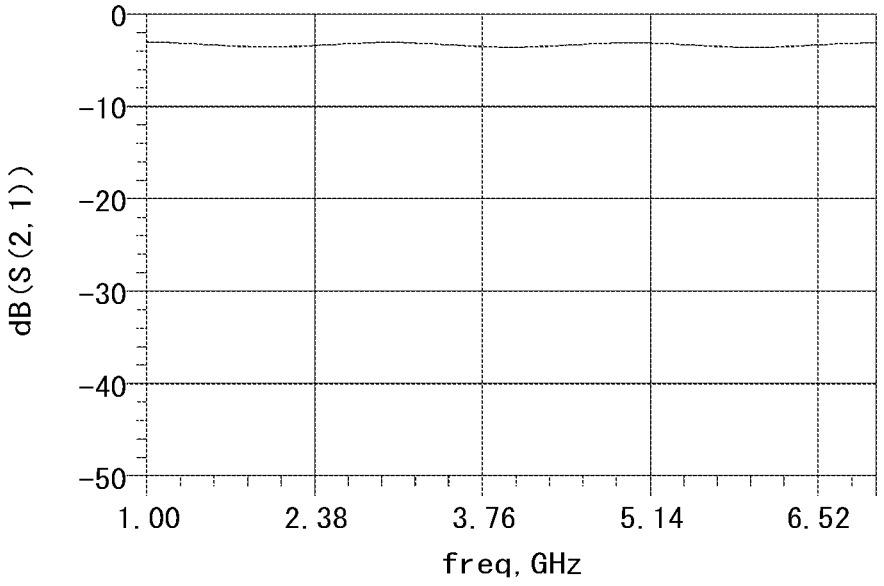
FIG. 8A is a view showing a wide band result of simulating transmission characteristics of the Wilkinson type combiner which employs the ideal resistor.
Figure 8B:
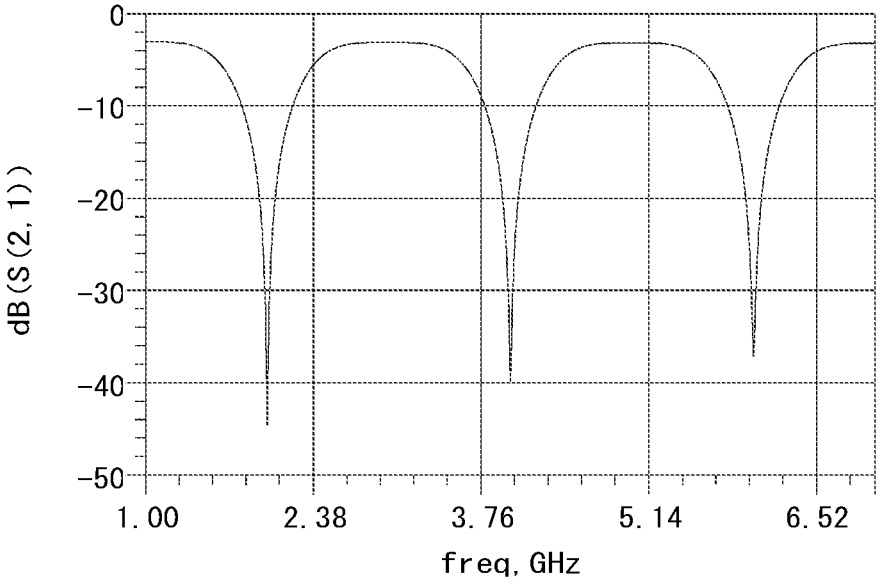
FIG. 8B is a view showing a wide band result of simulating transmission characteristics of the Wilkinson type combiner as shown in FIG. 6.

Because of the function for filtering the harmonic band, the use of the Wilkinson type combiner according to Example 1 is advantageous. FIG. 8A is a view showing a wide band transmission characteristics when using the ideal resistor for the isolation resistor of the Wilkinson type combiner as shown in FIG. 1. FIG. 8B is a view showing the wide band transmission characteristics of the Wilkinson type combiner as shown in FIG. 6.

The transmission characteristics of the Wilkinson type combiner according to Comparative example 1 (FIG. 1) when using the ideal resistor for the isolation resistor are optimized at 1 GHz. Even-ordered harmonic bands at 2 GHz, 4 GHz, 6 GHz are output without being attenuated. On the contrary, the transmission characteristics of the Wilkinson type combiner according to Example 1 (FIG. 6) show that the even-ordered harmonic bands at 2 GHz, 4 GHz, 6 GHz are output while being attenuated (filtered) to the level around −40 dB. Since the balun is installed in the isolation resistor, the filtering function of the balun is derived from Example 1.

Upon output of the power amplifier using the combiner, an out-band filter has to be inserted so as to eliminate the unwanted wave from the output wave. Application of Example 1 attenuates the harmonic, thus ensuring to ease the out-band filter specification.

Modified Example 1

Figure 9:
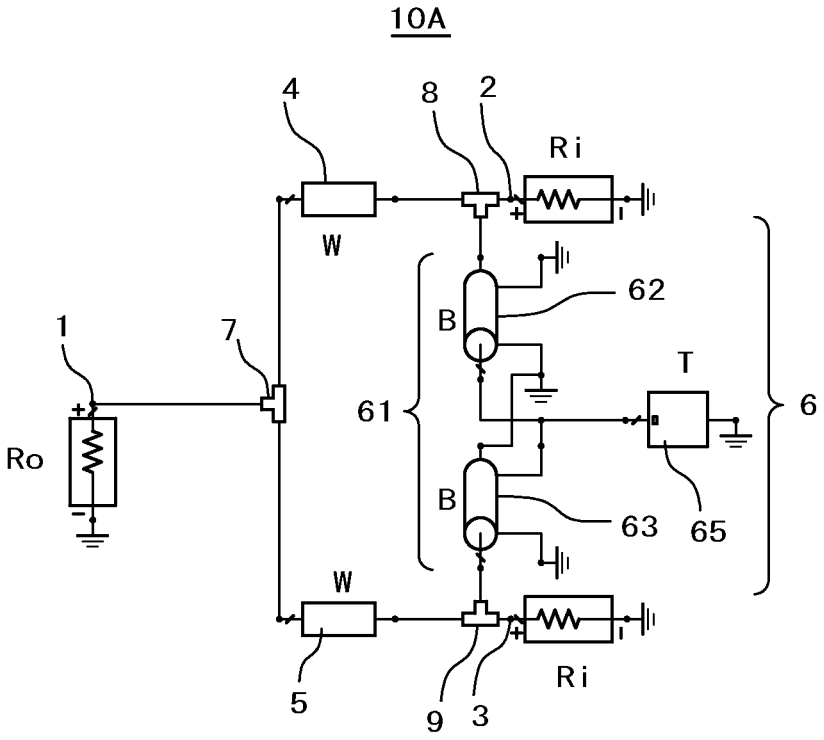
FIG. 9 is a view showing a structure of a Wilkinson type combiner according to Modified example 1.

The Wilkinson type combiner according to Modified example 1 will be described referring to FIG. 9. FIG. 9 is a view showing a structure of the Wilkinson type combiner according to Modified example 1.

A Wilkinson type combiner 10A according to Modified example 1 is formed by eliminating the impedance converter 64 from the Wilkinson type combiner 10 according to Example 1. In order to eliminate the impedance converter 64, it is necessary to satisfy the following formula (4) where each impedance of the semi-rigid cables 62, 63 is designated as B, and the impedance of the terminating resistor 65 is designated as T:

$$B/2=T \quad (4).$$

Figure 10A:
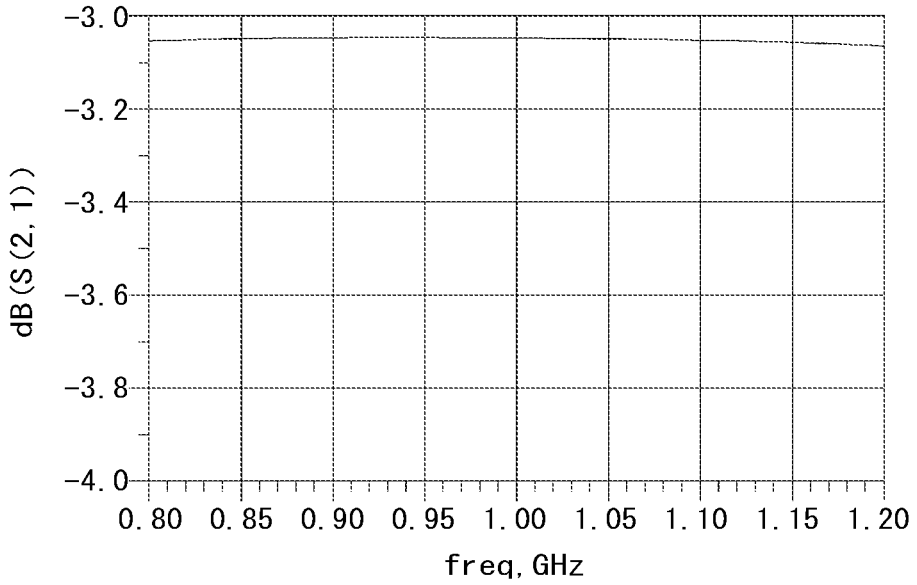
FIG. 10A is a view showing a result of simulating transmission characteristics of the Wilkinson type combiner as shown in FIG. 9.
Figure 10B:
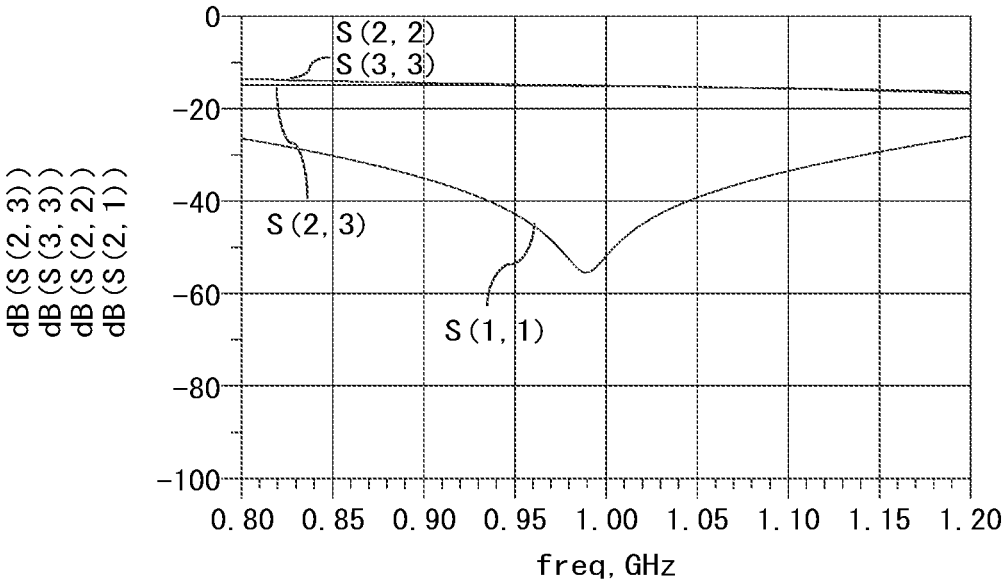
FIG. 10B is a view showing a result of simulating reflection characteristics and isolation characteristics of the Wilkinson type combiner as shown in FIG. 9.
Figure 10C:
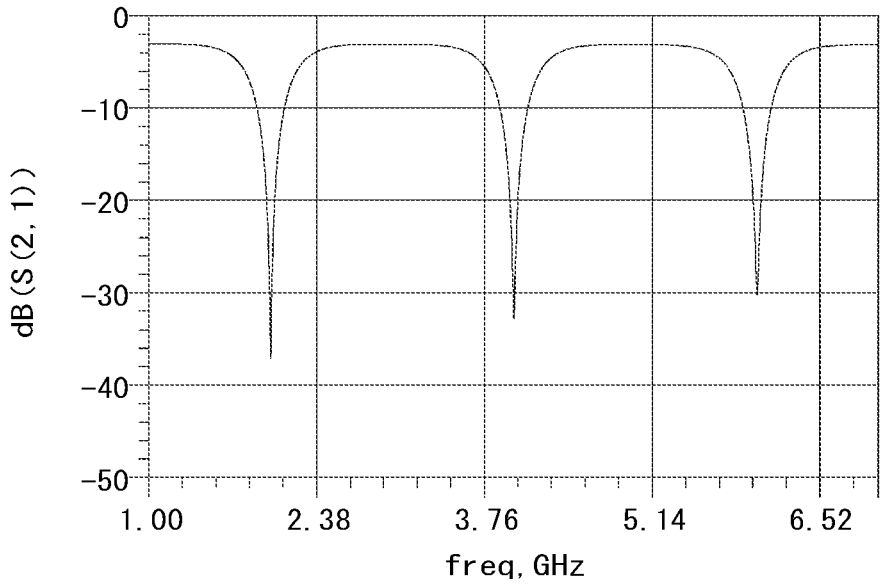
FIG. 10C is a view showing a wide band result of simulating transmission characteristics of the Wilkinson type combiner as shown in FIG. 9.

Characteristics of the Wilkinson type combiner 10A will be described referring to FIGS. 10A, 10B, 10C. FIG. 10A is a view showing a result of simulating transmission characteristics of the Wilkinson type combiner as shown in FIG. 9. FIG. 10B is a view showing a result of simulating reflection characteristics and isolation characteristics of the Wilkinson type combiner as shown in FIG. 9. FIG. 10C is a view showing wide band transmission characteristics of the Wilkinson type combiner as shown in FIG. 9.

The Wilkinson type combiner 10A is subjected to simulation under the conditions of Ro=50Ω, Ri=50Ω, B=100Ω, T=50Ω, W=70.7Ω, and fc=1 GHz. The terminating resistor 65 with high rated power is employed.

As FIGS. 10A, 10B show, characteristics of the Wilkinson type combiner 10A are as good as those of Example 1 (FIGS. 7A, 7B) except slight degradation in the reflection characteristics and the isolation characteristics of the input port. The S(2,1) is approximately −3.05 dB. The S(1,1) is in the range approximately from −25 to −50 dB. The S(2,2) is approximately −14 dB. The S(3,3) is approximately −14 dB. The S(2,3) is approximately −15 dB.

Although the S(2,2), S(3,3), S(2,3) show degradation compared with those of Example 1 (FIG. 7B) by the amount from 5 to 15 dB, the modified example is still practicable. The Wilkinson type combiner according to Modified example 1 is optimized at 1 GHz. It is confirmed that the transmission loss (S(2,1)) has been largely attenuated at 2 GHz, 4 GHz, 6 GHz to the level around −30 dB like Example 1 (FIG. 8B). It shows that the even-ordered harmonic bands are attenuated (filtered).

The structure of Modified example 1 is effective for the case where there is no space for disposing the impedance converter 64.

Problems of Example 1 and Modified Example 1

Figure 11:
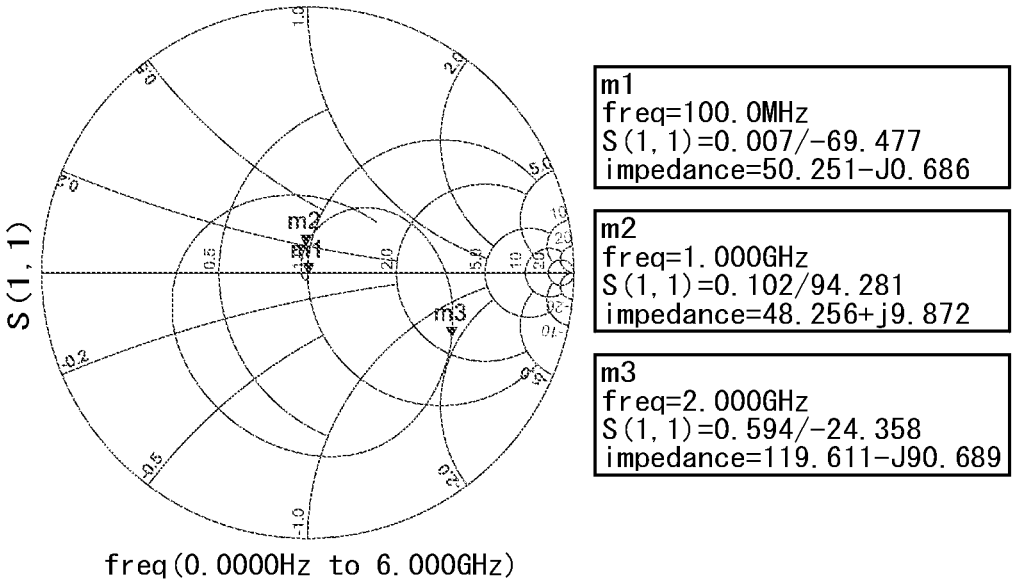
FIG. 11 is a Smith chart showing frequency characteristics of a high power resistant terminating resistor employed in the Wilkinson type combiner as shown in FIG. 6.

FIG. 11 is a Smith chart indicating the impedance of the terminating resistor with high rated power, which has been used for the simulation. As the frequency is increased, the impedance of the terminating resistor 65 (ideal value: 50Ω) deviates from the ideal value of 50Ω. At 100 MHz (m1), the impedance is still around 50Ω, and at 1 GHz (m2), the characteristic is still approximate to 50Ω. As the frequency is further increased, the impedance starts shifting from 50Ω, and largely deviates from 50Ω at 2 GHz (m3).

Figure 12A:
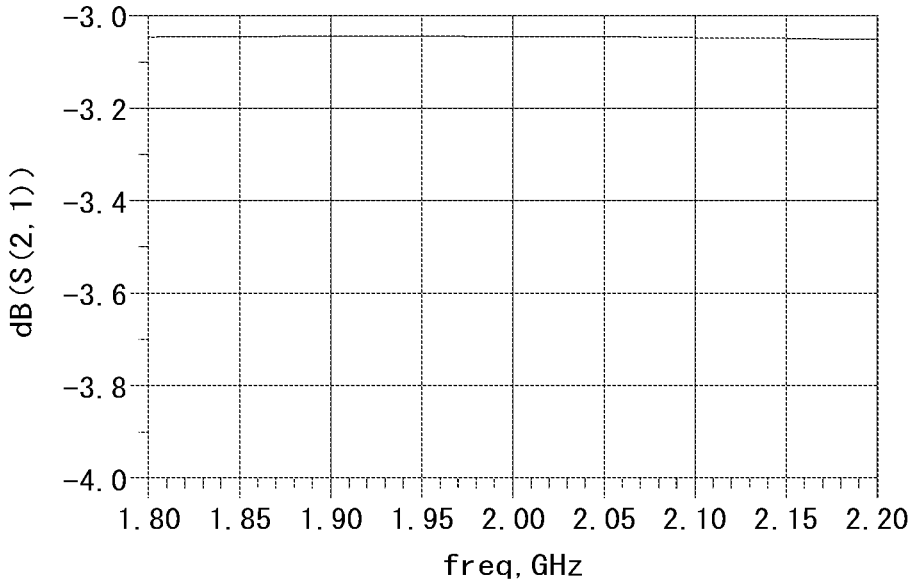
FIG. 12A is a view showing a result of simulating transmission characteristics of the Wilkinson type combiner as shown in FIG. 6.
Figure 12B:
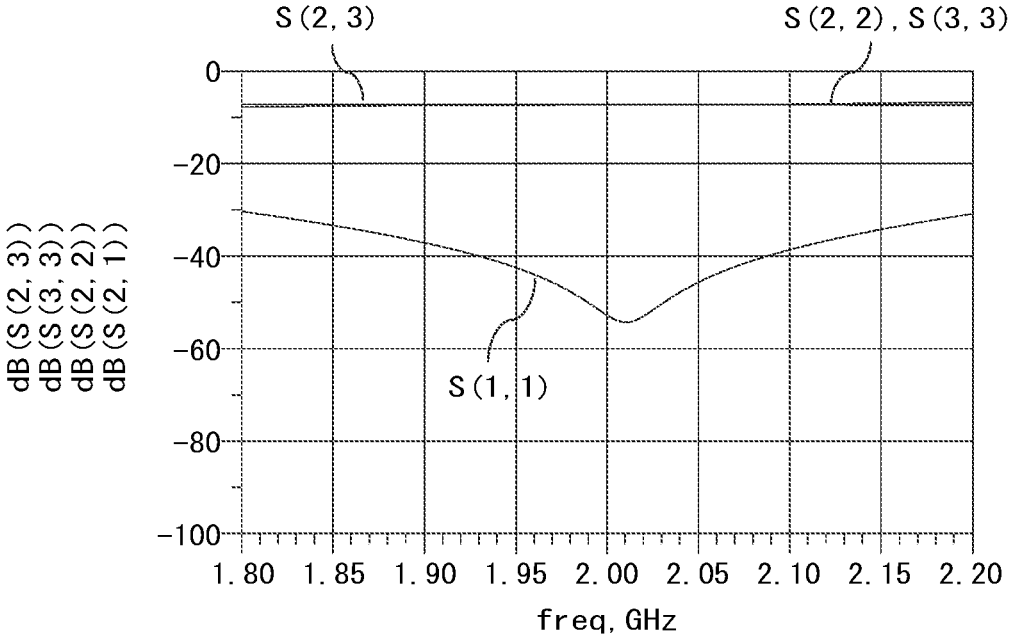
FIG. 12B is a view showing a result of simulating reflection characteristics and isolation characteristics of the Wilkinson type combiner as shown in FIG. 6.
Figure 12C:
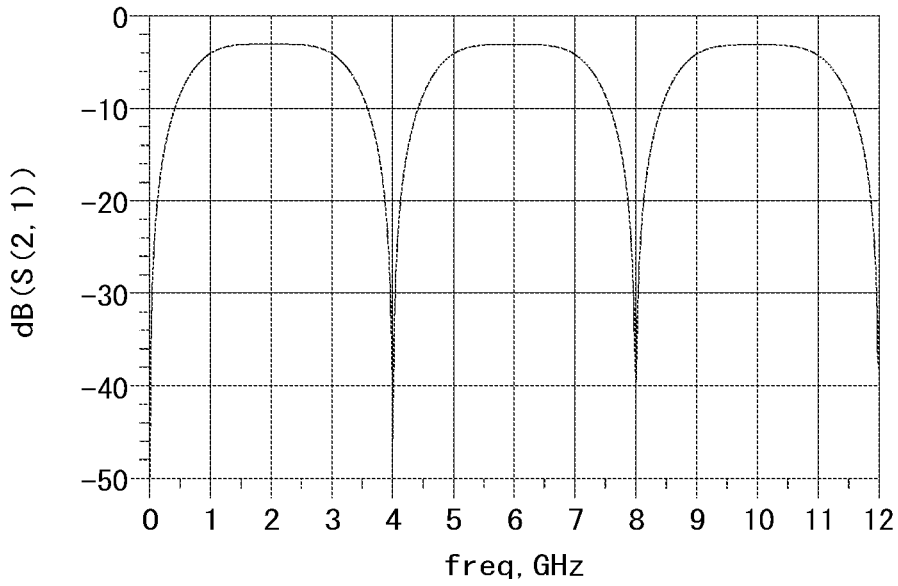
FIG. 12C is a view showing a wide band result of simulating transmission characteristics of the Wilkinson type combiner as shown in FIG. 6.

Characteristics of the Wilkinson type combiner optimized at 2 GHz will be described referring to FIGS. 12A, 12B, 12C.

Each line length of W, B, I, that is, λ/4 of the Wilkinson type combiner according to Example 1 (FIG. 6) is optimized at 2 GHz for the simulation under the conditions of Ro=50Ω, Ri=50Ω, W=70.7Ω, T=50Ω, B=50Ω, I=35.35Ω, using the terminating resistor with high rated power similar to the one as shown in FIG. 6.

The transmission characteristics and the reflection characteristics of the output port are as good as those shown in FIGS. 7A, 7B. However, it is confirmed that the reflection characteristics of the input port and the isolation characteristics have been largely degraded compared with those shown in FIGS. 7A, 7B.

The S(2,1) is approximately −3.05 dB. The S(1,1) is in the range approximately from −30 to −55 dB. The S(2,2) is approximately −7 dB. The S(3,3) is approximately −7 dB. The S(2,3) is approximately −7 dB.

The S(2,1) and S(1,1) are equivalent to those shown in FIGS. 7A, 7B. However, the S(2,2), S(3,3), S(2,3) show degradation by the amount corresponding to 7 dB compared with the case shown in FIG. 7B. The Wilkinson type combiner is optimized at 2 GHz. It is confirmed that the transmission loss (S(2,1)) has been largely attenuated at 4 GHz, 8 GHz, 12 GHz to the level around −40 dB like Example 1 (FIG. 8B). This shows that the even-ordered (second-order, fourth-order, sixth-order, and the like) harmonic band is attenuated (filtered).

For the high output combiner-divider, the reflection loss of the input port, and the isolation measured approximately −10 dB are not satisfactory. As described above, the structure of Example 1 (FIG. 6) may fail to exhibit good characteristics if the frequency is increased.

Example 2

Figure 13:
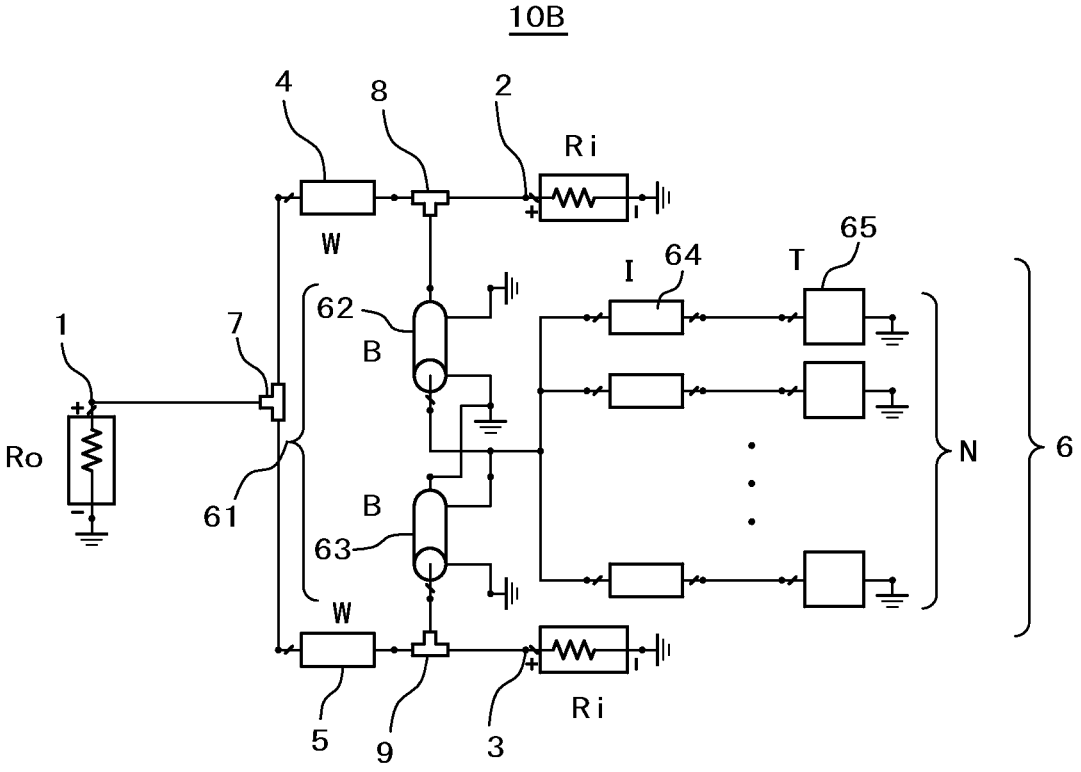
FIG. 13 is a view showing a structure of a Wilkinson type combiner according to Example 2.

A Wilkinson type combiner according to Example 2 will be described referring to FIGS. 13, 14A, 14B, 14C, 15. FIG. 13 is a view showing a structure of the Wilkinson type combiner according to Example 2.

As FIG. 13 shows, a Wilkinson type combiner 10B has the combiner 7, the impedance converter 4, the brancher 8 disposed between the first port 1 and the second port 2, the combiner 7, the impedance converter 5, a brancher 9 disposed between the first port 1 and the third port 3, and the isolation resistor 6 disposed between the second port 2 and the third port 3. The first port 1 is the output port, and the second port 2 and the third port 3 are the input ports.

Assuming that each impedance of the input terminals of the second port 2 and the third port 3 is designated as Ri, an impedance of the output terminals of the first port 1 is designated as Ro, and the center frequency is designated as fc, each impedance (W) of the impedance converters 4, 5 is obtained by the above-described formula (1).

The isolation resistor 6 of the Wilkinson type combiner 10B is constituted by the balun 61, N impedance converters 64, and N terminating resistors 65.

Example 1 (FIG. 6) is configured to have the single impedance converter 64, and the single terminating resistor 65. Example 2 (FIG. 13) is configured to have N combinations of the impedance converter 64 and the terminating resistor 65.

An impedance of the impedance converter 64 designated as I is obtained by the following formula (5).

$$I=(BTN/2)^{1/2} \quad (5)$$

The structure allows increase in the number of the terminating resistors 65 to N. It is therefore possible to lower the power resistance of the terminating resistor 65 to 1/N of the required value.

Figure 14A:
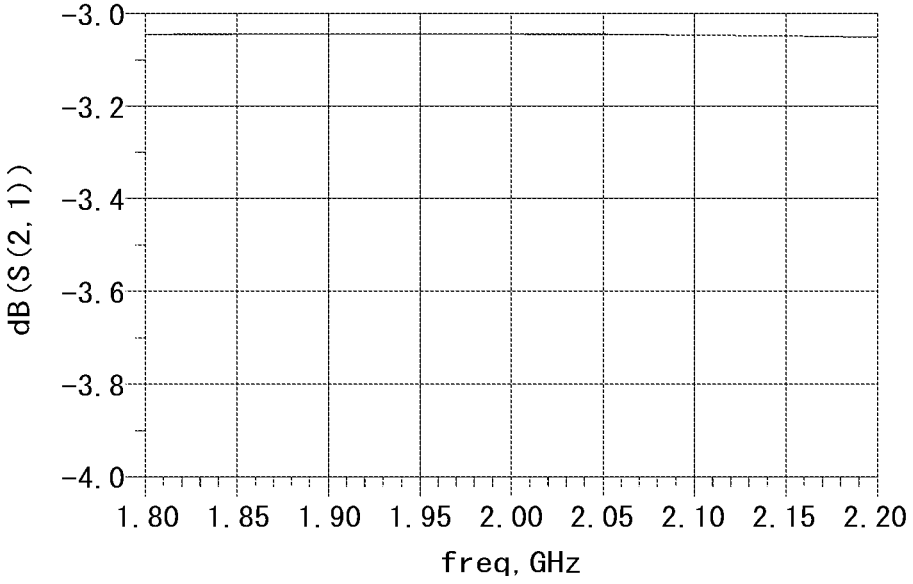
FIG. 14A is a view showing a result of simulating transmission characteristics obtained as a result of using four terminating resistors for the Wilkinson type combiner as shown in FIG. 13.
Figure 14B:
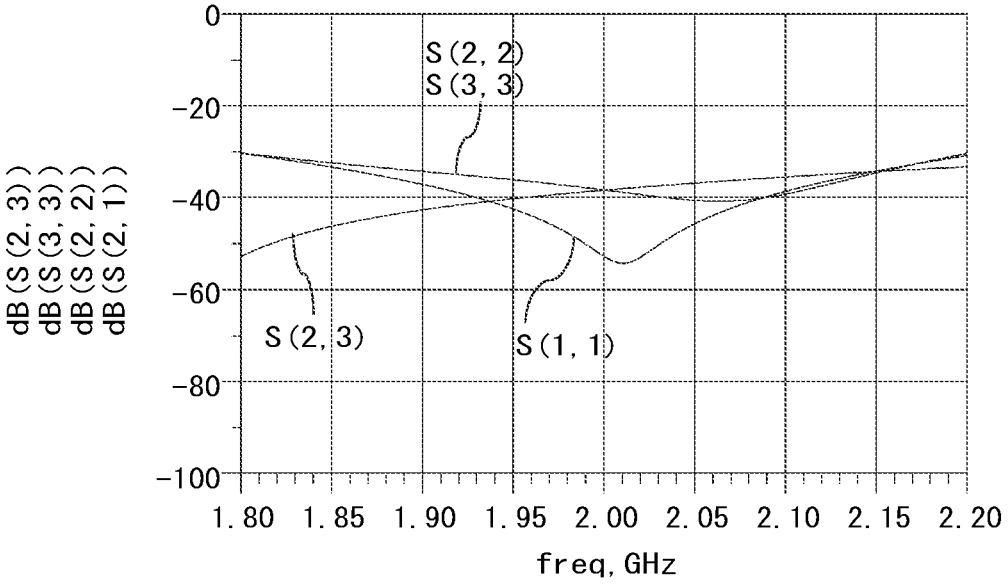
FIG. 14B is a view showing a result of simulating reflection characteristics and isolation characteristics of the Wilkinson type combiner as shown in FIG. 13.
Figure 14C:
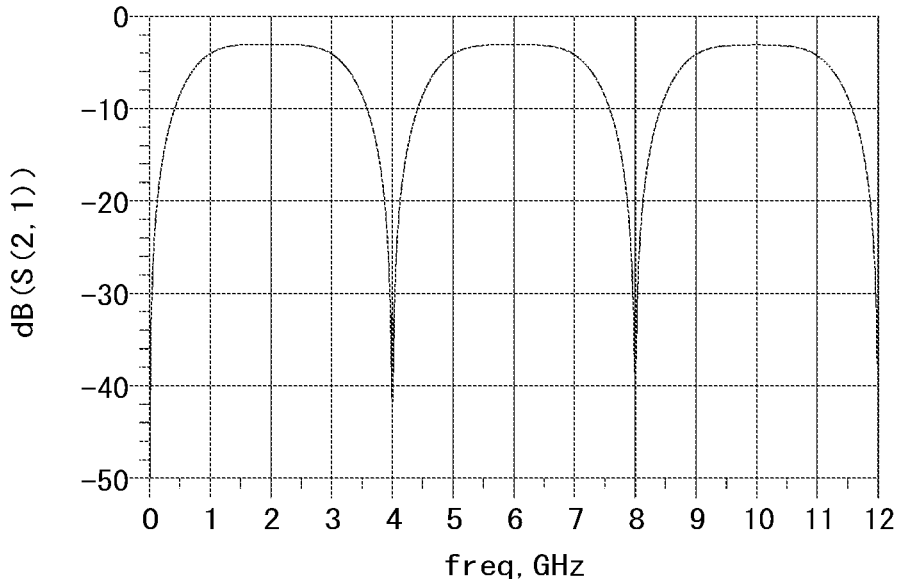
FIG. 14C is a view showing a wide band result of simulating transmission characteristics of the Wilkinson type combiner as shown in FIG. 13.

Characteristics of the Wilkinson type combiner 10A will be described referring to FIGS. 14A, 14B, 14C. FIG. 14A is a view showing a result of simulating transmission characteristics of the Wilkinson type combiner as shown in FIG. 13. FIG. 14B is a view showing a result of simulating reflection characteristics and isolation characteristics of the Wilkinson type combiner as shown in FIG. 13. FIG. 14C is a view showing wide band transmission characteristics of the Wilkinson type combiner as shown in FIG. 13.

The Wilkinson type combiner 10B is subjected to simulation under the conditions of Ro=50Ω, Ri=50Ω, W=70.7Ω, B=50Ω, T=50Ω, N=4, I=70.7Ω, and fc=2 GHz. Since four terminating resistors 8 are employed, the required power resistance is ¼ of that of the terminating resistor employed in Example 1 (FIG. 6).

FIGS. 14A, 14B show that all the transmission characteristics, reflection characteristics, and isolation characteristics are satisfactory. The S(2,1) is approximately −3.05 dB. The S(1,1) is in the range approximately from −30 to −55 dB. The S(2,2) is in the range approximately from −30 to −40 dB. The S(3,3) is in the range approximately from −30 to −40 dB. The S(2,3) is in the range approximately from −33 to −52 dB.

The Wilkinson type combiner according to Example 2 is optimized at 2 GHz. In this case, it is confirmed that the transmission loss (S(2,1)) has been largely attenuated at 4 GHz, 8 GHz to the level around −40 dB like Example 1 (FIG. 8B). It shows that the even-ordered harmonic band has been attenuated (filtered). As described above, in spite of the structure using multiple terminating resistors, the even-ordered harmonic band is filtered.

The terminating resistor 65 has its parasitic component enlarged as the power resistance becomes high. Example 2 is configured to lessen the influence of the parasitic component by increasing the number of the terminating resistors 65 to lower the power resistance by the amount corresponding to the increased number of the terminating resistors.

Figure 15:
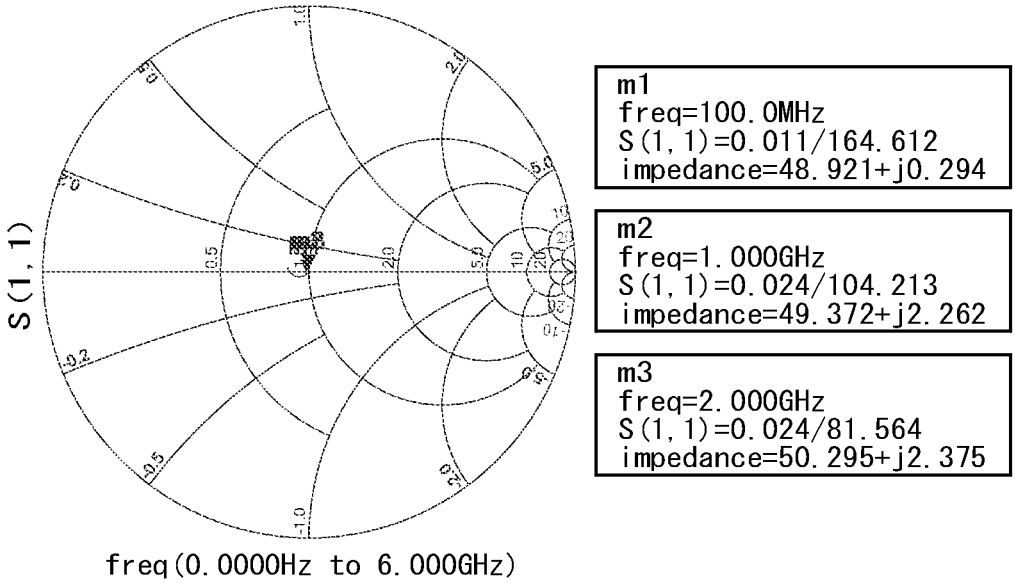
FIG. 15 is a Smith chart showing frequency characteristics of the terminating resistor employed in the Wilkinson type combiner as described referring to FIG. 14.

FIG. 15 is a Smith chart indicating impedance characteristics of the terminating resistor with power resistance ¼ of that of the terminating resistor employed as shown in FIG. 6. The chart as shown in FIG. 11 indicates the impedance at the location deviating from 50 Ω at 2 GHz. Meanwhile, the chart as shown in FIG. 15 indicates the impedance at the location near 50 Ω even at 2 GHz.

Increasing the required number of the terminating resistors of the structure according to Example 2 (FIG. 13) may provide the high frequency and high power Wilkinson type combiner.

Modified Example 2

Figure 16:
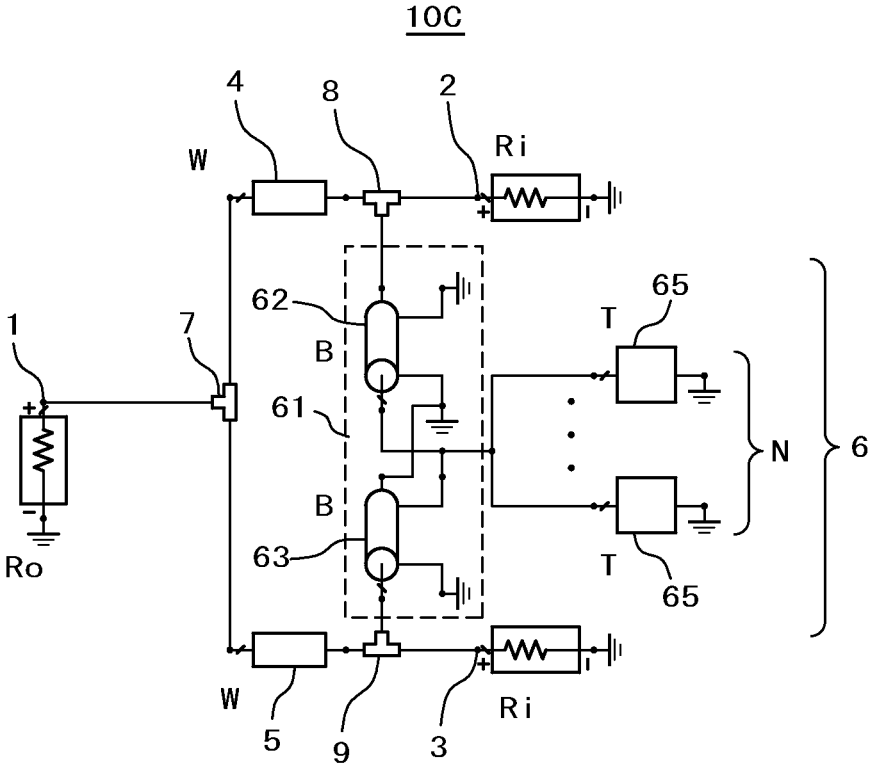
FIG. 16 is a view showing a structure of a Wilkinson type combiner according to Modified example 2.

A Wilkinson type combiner according to Modified example 2 will be described referring to FIGS. 16, 17A, 17B, 17C. FIG. 16 is a view showing a structure of the Wilkinson type combiner according to Modified example 2.

The Wilkinson type combiner 10C according to Modified example 2 is formed by eliminating the impedance converter 64 from the Wilkinson type combiner 10B according to Example 2. The structure of Example 2 (FIG. 13) has the combination which allows elimination of the impedance converter 64 like Modified example 1 (FIG. 9). Assuming that each impedance of the semi-rigid cables 62, 63 is designated as B, the impedance of the terminating resistor 65 is designated as T, and the number of the terminating resistors 65 is designated as N, the impedance converter 64 may be eliminated by satisfying the condition of the following formula (6):

$$B/2=TN \quad (6).$$

Figure 17A:
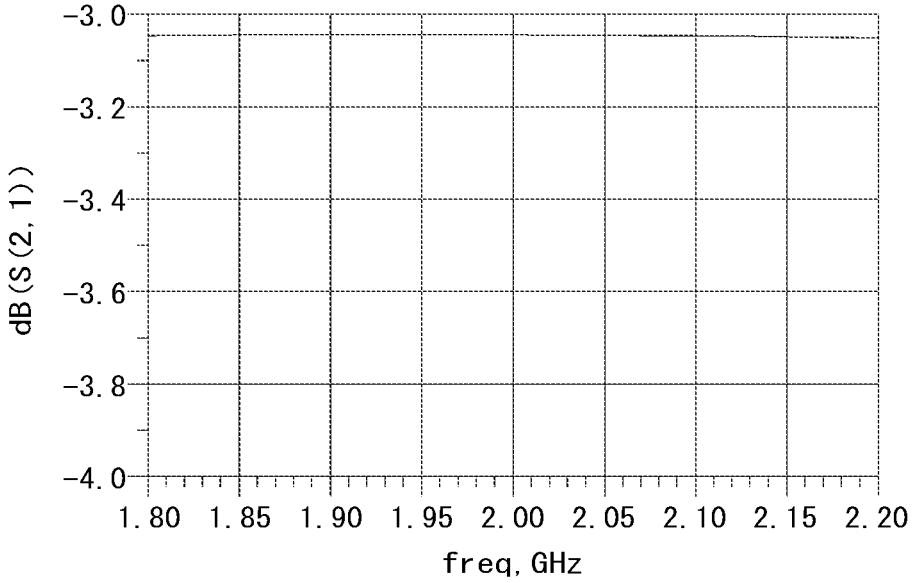
FIG. 17A is a view showing a result of simulating transmission characteristics of the Wilkinson type combiner as shown in FIG. 16.
Figure 17B:
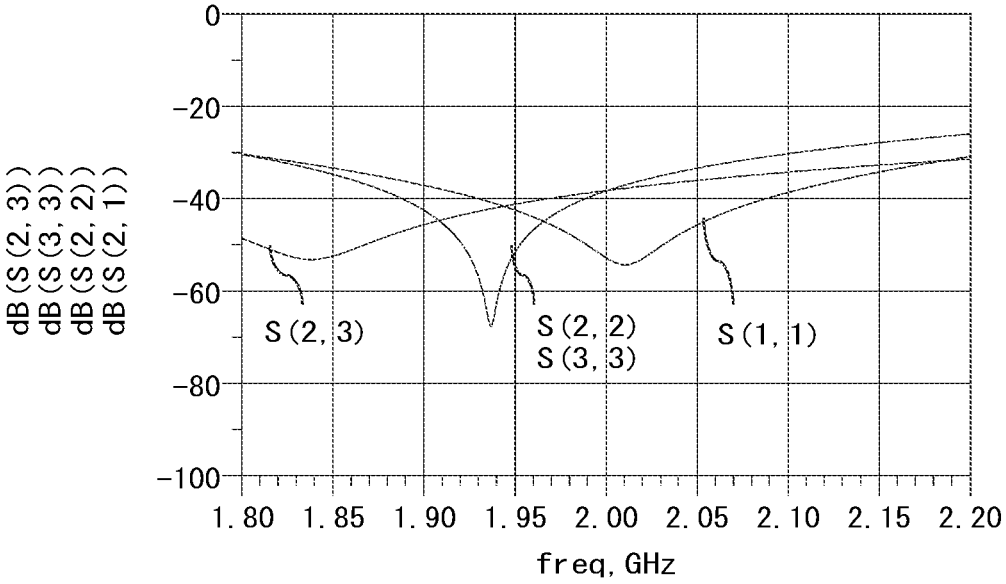
FIG. 17B is a view showing a result of simulating reflection characteristics and isolation characteristics of the Wilkinson type combiner as shown in FIG. 16.
Figure 17C:
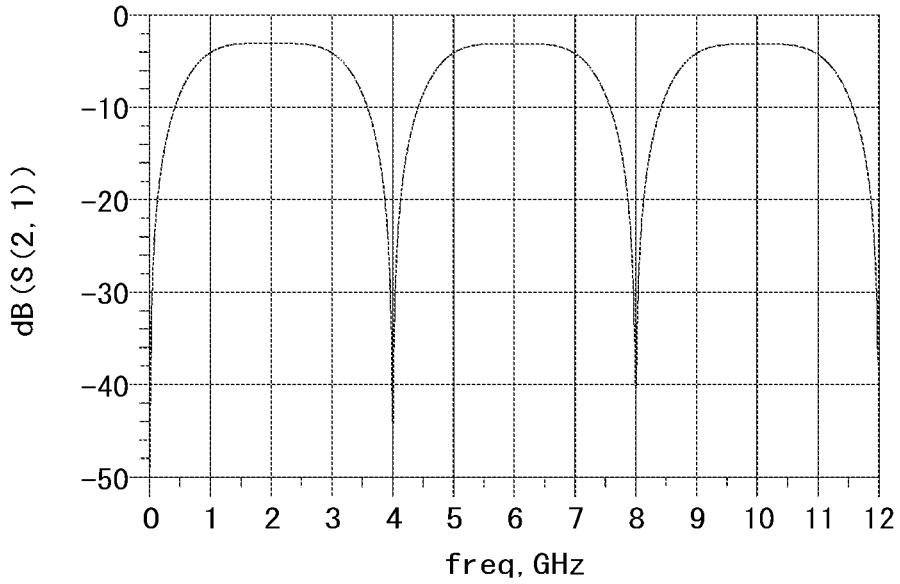
FIG. 17C is a view showing a wide band result of simulating transmission characteristics of the Wilkinson type combiner as shown in FIG. 16.

Characteristics of the Wilkinson type combiner 10C will be described referring to FIGS. 17A, 17B, 17C. FIG. 17A is a view showing a result of simulating transmission characteristics of the Wilkinson type combiner as shown in FIG. 16. FIG. 17B is a view showing a result of simulating reflection characteristics and isolation characteristics of the Wilkinson type combiner as shown in FIG. 16. FIG. 17C is a view showing the wide band transmission characteristics of the Wilkinson type combiner as shown in FIG. 16.

The Wilkinson type combiner 10C is subjected to simulation under the conditions of Ro=50Ω, Ri=50Ω, W=70.7Ω, B=50Ω, T=50Ω, N=2, and fc=2 GHz. The power resistance of the terminating resistor 65 is ½ of that of the terminating resistor as described in Example 1 (FIG. 6).

As FIGS. 17A, 17B show, characteristics of the Wilkinson type combiner 10C according to Modified example 2 (FIG. 16) are as good as those of the Wilkinson type combiner 10B according to Example 2 (FIG. 13). The S(2,1) is approximately −3.05 dB. The S(1,1) is in the range approximately from −30 to −54 DB. The S(2,2) is in the range approximately from −25 to −67 dB. The S(3,3) is in the range approximately from −25 to −67 dB. The S(2,3) is in the range approximately from −30 to −53 dB.

The Wilkinson type combiner according to Modified example 2 is optimized at 2 GHz. It is confirmed that the transmission loss (S(2,1)) has been largely attenuated to the level around −40 dB at 4 GHz, 6 GHz, 12 GHz like the case of Example 2 (FIG. 14C). It is also shown that the even-ordered harmonic band has been attenuated (filtered).

The structure according to Modified example 2 (FIG. 16) is effective for the case where there is no space for disposing the impedance converter.

Modified Example 3

Figure 18:
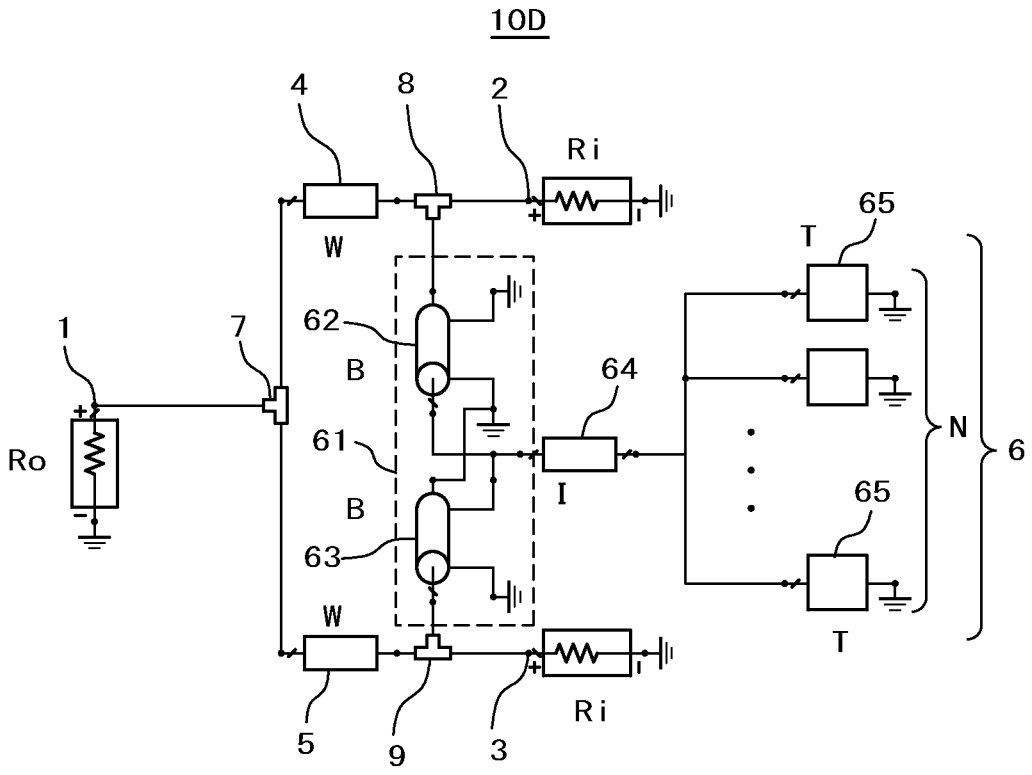
FIG. 18 is a view showing a structure of a Wilkinson type combiner according to Modified example 3.

A Wilkinson type combiner according to Modified example 3 will be described referring to FIGS. 18, 19A, 19B, 19C. FIG. 18 is a view showing a structure of the Wilkinson type combiner according to Modified example 3.

The Wilkinson type combiner 10B according to Example 2 (FIG. 13) employs N impedance converters 64, and N terminating resistors 65, respectively. The Wilkinson type combiner 10D according to Modified example 3 employs a group of the impedance converters 64.

Assuming that the impedance of the impedance converter 64 is designated as I, the impedance converters 64 may be combined into the single group in the case of satisfying the condition of the following formula (7):

$$I=(BT/2N)^{1/2} \quad (7).$$

Figure 19A:
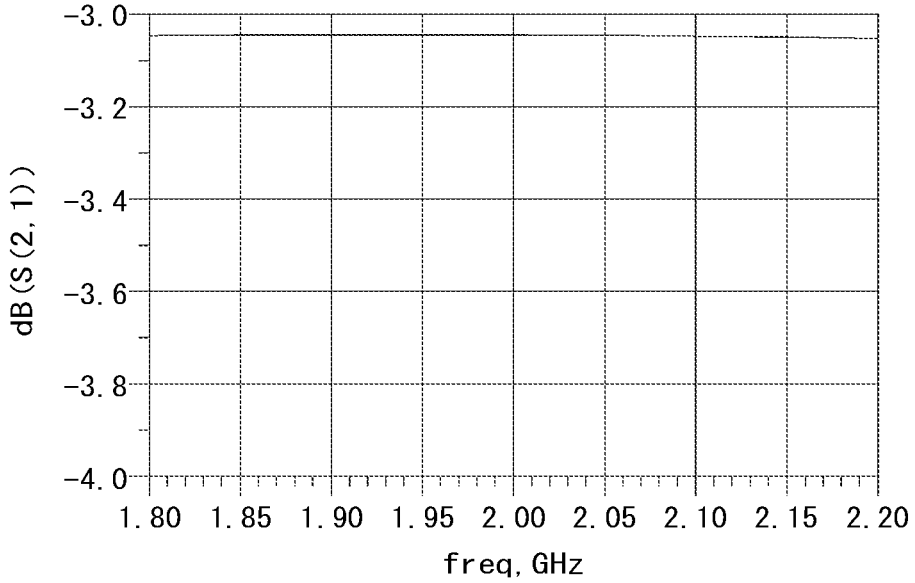
FIG. 19A is a view showing a result of simulating transmission characteristics obtained as a result of using four terminating resistors for the Wilkinson type combiner as shown in FIG. 18.
Figure 19B:
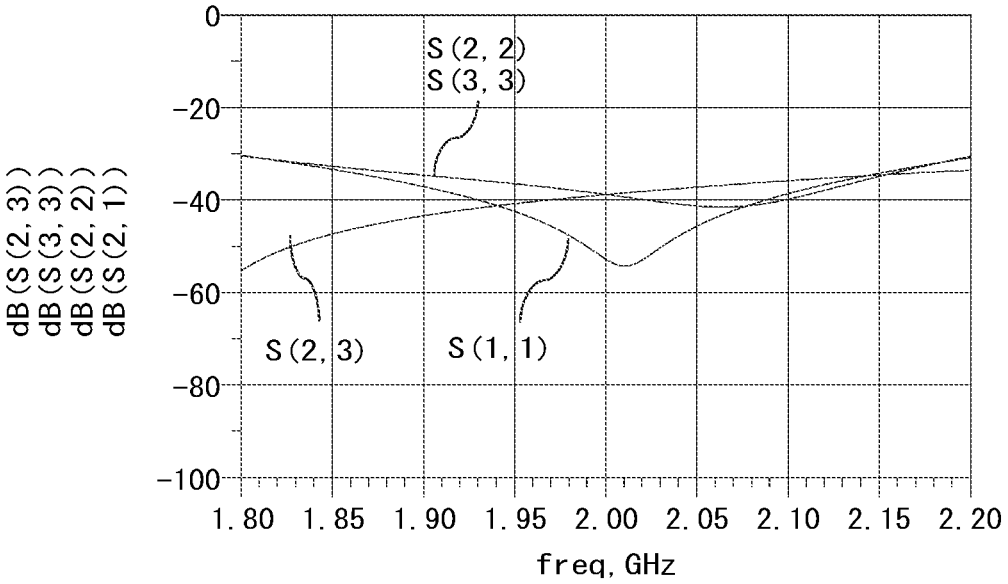
FIG. 19B is a view showing reflection characteristics and isolation characteristics of the Wilkinson type combiner as shown in FIG. 18.
Figure 19C:
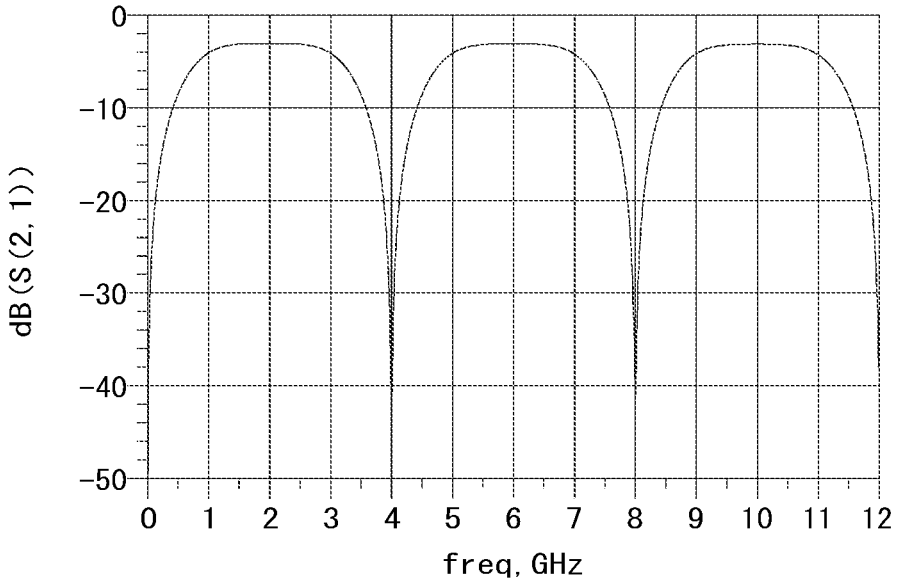
FIG. 19C is a view showing a wide band result of simulating transmission characteristics of the Wilkinson type combiner as shown in FIG. 18.

Then characteristics of the Wilkinson type combiner 10D will be described referring to FIGS. 19A, 19B, 19C. FIG. 19A is a view showing a result of simulating transmission characteristics of the Wilkinson type combiner as shown in FIG. 18. FIG. 19B is a view showing a result of simulating reflection characteristics and isolation characteristics of the Wilkinson type combiner as shown in FIG. 18. FIG. 19C is a view showing wide band transmission characteristics of the Wilkinson type combiner as shown in FIG. 18.

The Wilkinson type combiner 10D is subjected to simulation under the conditions of Ro=50Ω, Ri=50Ω, W=70.7Ω, B=50Ω, T=50Ω, I=17.7Ω, N=4, and fc=2 GHz. The power resistance of the terminating resistor 65 is ¼ of the one as described in Example 1 (FIG. 6).

As FIGS. 19A, 19B show, characteristics of the Wilkinson type combiner 10D according to Modified example 3 (FIG. 18) are as good as those of the Wilkinson type combiner 10B according to Example 2 (FIG. 13).

The S(2,1) is approximately −3.5 dB. The S(1,1) is in the range approximately from −30 to −54 dB. The S(2,2) is in the range approximately from −30 to −40 dB. The S(3,3) is in the range approximately from −30 to −40 dB. The S(2,3) is in the range approximately from −34 to −55 dB.

The Wilkinson type combiner according to Modified example 3 (FIG. 18) is optimized at 2 GHz. It is confirmed that the transmission loss (S(2,1)) has been largely attenuated to the level around −40 dB at 4 GHz, 6 GHz, 12 GHz like Example 2 (FIG. 14C). It shows that the even-ordered harmonic band has been attenuated (filtered).

The structure according to Example 2 (FIG. 13) needs to dispose N impedance converters. Meanwhile, the structure according to Modified example 3 (FIG. 18) allows multiple impedance converters to be combined into the single group. The structure is effective for the case where there is no space for disposing many impedance converters.

The Wilkinson type combiner according to Embodiment 1 (Example 1, Modified example 1, Example 2, Modified example 2, and Modified example 3), have been described. The invention is applicable to the Wilkinson type divider.

Specifically, when the signal is input from the first port 1 of any one of the Wilkinson type combiners 10, 10A, 10B, 10C, 10D, the combiner 7 serves as the divider so that the divided signals are output from the second port 2 and the third port 3, respectively. It is therefore possible to enable each of the Wilkinson type combiners 10, 10A, 10B, 10C, 10D to function as the Wilkinson type divider.

Embodiment 1 provides the following advantageous effects.

(1) The Wilkinson type combiner-divider employs the balun for the isolation unit to allow improvement in isolation characteristics, and attenuation of the even-ordered harmonic band.

(2) In the Wilkinson type combiner-divider as described in (1), the terminating resistor is connected to the balun for the isolation unit to allow improvement in the isolation characteristics.

(3) In the Wilkinson type combiner-divider as described in (2), the impedance converter is inserted between the terminating resistor and the balun to allow diversification of usable types of both the balun and the terminating resistor.

(4) In the Wilkinson type combiner-divider as described in (2), the terminating resistors are connected to the balun for the isolation unit in parallel multiple lines to secure good characteristics even at high frequency.

(5) In the Wilkinson type combiner-divider as described in (3), the number of usable types of the terminating resistor is increased by connecting circuits of the terminating resistor and the impedance converter in parallel multiple lines to secure good characteristics even at high frequency.

(6) In the Wilkinson type combiner-divider as described in (3), the number of usable types of terminating resistor is increased by connecting multiple terminating resistors to the single impedance converter in parallel lines to secure good characteristics even at high frequency.

Embodiment 2

Comparative Example 2

Figure 20:
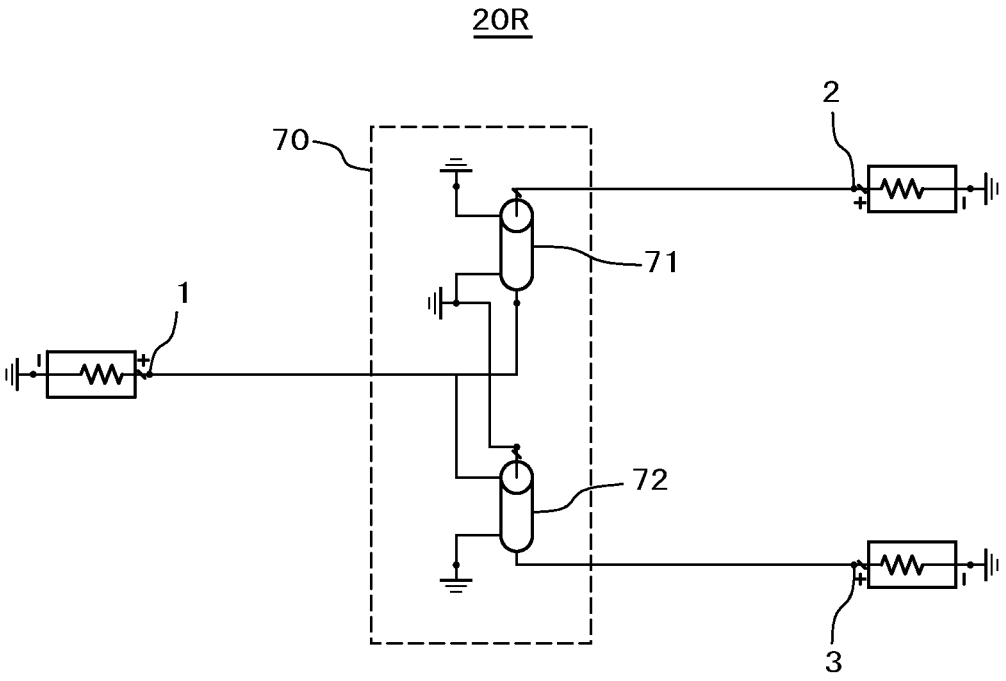
FIG. 20 is a view showing a structure of a balun type combiner according to Comparative example 2.

There is a balun type combiner-divider with the structure different from that of the one according to Embodiment 1. The balun type combiner-divider according to the technology (Comparative example 2) which has been examined by the inventors preceding application of the present invention will be described referring to FIGS. 20, 21A, 21B. FIG. 20 is a view showing a structure of the balun type combiner-divider according to Comparative example 2.

A balun type combiner-divider 20R according to Comparative example 2 employs two semi-rigid cables 71, 72 for a balun 70. A core wire at one end of the semi-rigid cable 71 is connected to a balanced port 2, and a core wire at one end of the semi-rigid cable 72 is connected to a balanced port 3. Core wires and outer conductor of the two semi-rigid cables 71, 72 are connected at the other ends thereof, respectively. The core wire of the semi-rigid cable 71 is connected to an unbalanced port 1, and the core wire of the other semi-rigid cable 72 is connected to GND (grounded).

The signal input from the unbalanced port 1 is divided (distributed) into antiphase signals to the balanced ports 2 and 3, respectively. The antiphase signals input from the balanced ports 2 and 3 will be combined to the unbalanced port 1.

It is assumed that each impedance of the input terminals of the balanced ports 2 and 3 is designated as Ri, an impedance of the output terminal of the unbalanced port 1 is designated as Ro, each impedance of the semi-rigid cables 71, 72 is designed as B, and the center frequency is designated as fc.

Figure 21A:
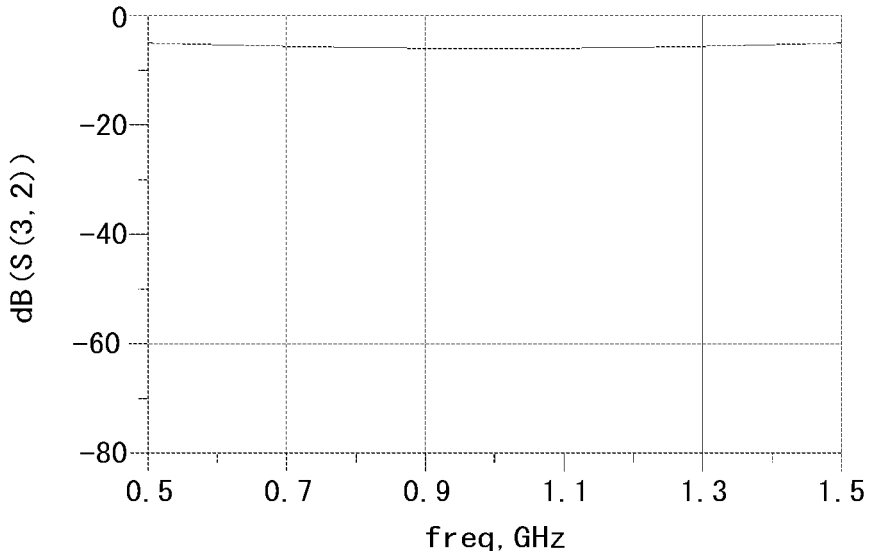
FIG. 21A is a view showing a result of simulating transmission characteristics of the balun type combiner as shown in FIG. 20.
Figure 21B:
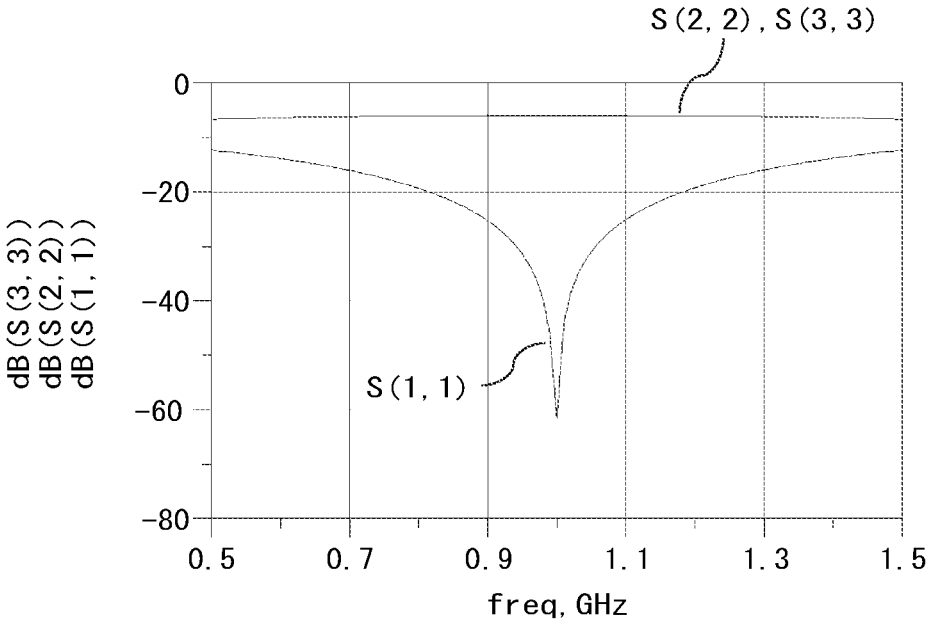
FIG. 21B is a view showing a result of simulating reflection characteristics and isolation characteristics of the balun type combiner as shown in FIG. 20.

Characteristics of the balun type combiner-divider 20R will be described referring to FIGS. 21A, 22B. FIG. 21A is a view showing a result of simulating isolation characteristics of the balun type combiner-divider as shown in FIG. 20. FIG. 21B is a view showing a result of simulating reflection characteristics of the balun type combiner-divider as shown in FIG. 20.

The parameters for the simulations of the balun type combiner-divider 20R are set to be Ro=50Ω, Ri=50Ω, B=70.7Ω, and fc=1 GHz.

As FIG. 21A shows, the isolation (S(3,2)) between the balanced ports 2 and 3 is as small as approximately −5 dB. As a result, the impedance is matched only if the antiphase signals each with equal amplitude have been input from the balanced ports 2, 3. Otherwise each reflection loss (S(2,2), S(3,3)) of the balanced ports 2, 3 becomes as large as approximately −5 dB as shown in FIG. 21B.

In the case of low isolation between the balanced ports of the balun type combiner-divider according to Comparative example 2, and fluctuation of the load connected to the balanced ports 2, 3, the impedance matching condition is no longer satisfied. This may change the combined-divided amount, and generate reflected waves at the balanced ports 2, 3, causing the problem of degrading the operation performance of the combiner-divider.

The balun type combiner-divider according to the embodiment is formed by adding two transmission lines each with quarter wavelength between the balanced ports to the structure of the balun type combiner-divider according to Comparative example 2. The transmission lines are connected in series, and a terminator for impedance matching is disposed at an intermediate point. The signal input from one of the balanced ports is divided into a signal that propagates on the transmission line, and a signal that propagates on the semi-rigid cable. The phase of signal propagating along the transmission line changes to 180°, because the waveguide length corresponds to the half the wavelength. On the other hand, the phase of signal propagating along the semi-rigid cable changes to 0°, because the respective centers of the semi-rigid cables connects alternately. As the result, these two signals cancel each other achieving high isolation between the balanced ports.

It is possible to divide or combine the differential signals over a wide band while realizing isolation between the balanced ports. The use of the semi-rigid cable for the balun section allows three-dimensional arrangement which is substantially impracticable by pattern designing. This makes it possible to provide the compact circuit. Example 3

Figure 22:
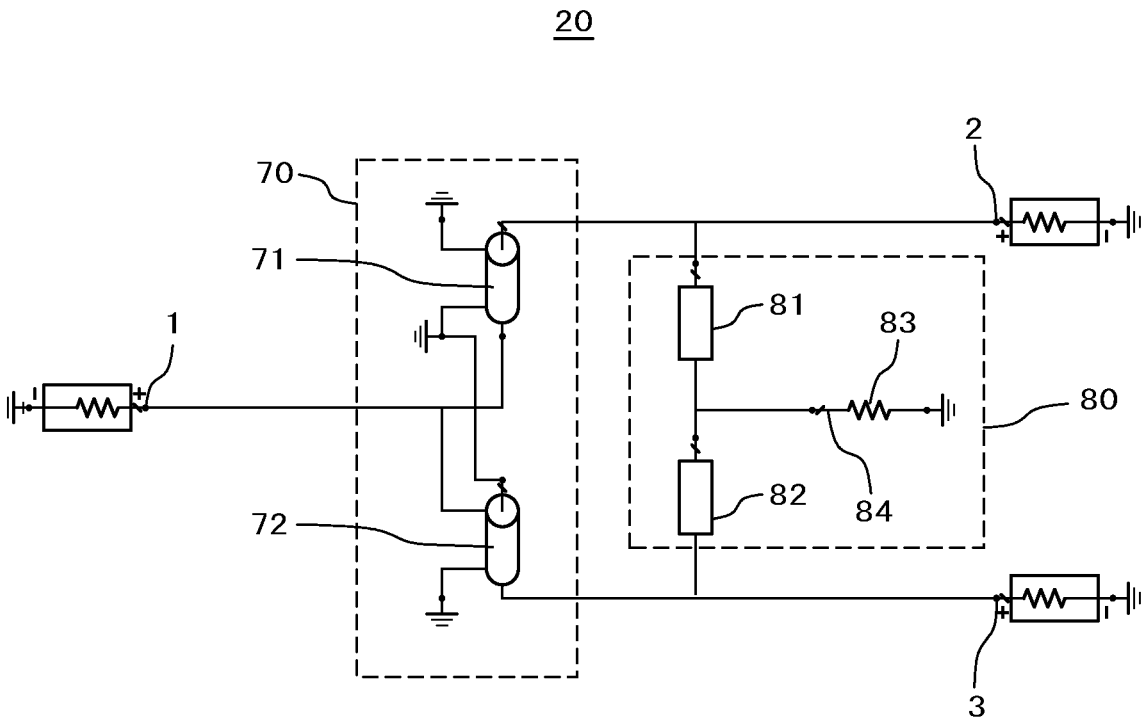
FIG. 22 is a view showing a structure of a balun type combiner according to Example 3.

A balun type combiner-divider according to Example 3 will be described referring to FIGS. 22, 23A, 23B. FIG. 22 is a view showing a structure of the balun type combiner-divider according to Example 3.

A balun type combiner-divider 20 according to Example 3 includes a balun 70, and an isolation unit 80 between the first balanced port 2 and the second balanced port 3. The balun 70 includes the semi-rigid cable 71 and the semi-rigid cable 72. One end of a core wire of the semi-rigid cable 71 is connected to the first balanced port 2, and one end of the core wire of the semi-rigid cable 72 is connected to the second balanced port 3. The core wires and the outer conductors at the other ends of the semi-rigid cables 71, 72 are connected with each other. The other end of the core wire of the semi-rigid cable 71 is connected to the unbalanced port 1, and the other end of the core wire of the semi-rigid cable 72 is connected to GND. As the core wires and the outer conductors of the semi-rigid cables 71, 72 are connected with each other, the signal input from the unbalanced port 1 will be divided to the first balanced port 2 and the second balanced port 3 as the differential signals.

Each of the semi-rigid cables 71, 72 serves to perform impedance conversion between the unbalanced port 1 and the first balanced port 2, and the impedance conversion between the unbalanced port 1 and the second balanced port 3. For example, if each impedance of the first balanced port 2, the second balanced port 3, and the unbalanced port 1 is 50Ω, the impedance matching is established by adjusting each impedance of the semi-rigid cables 71 and 72 to $(2\times50\times50)^{1/2}\approx70.7\Omega$, and the cable length to the quarter wavelength.

The isolation unit 80 includes transmission lines 81, 82, and a terminating resistor 83 for isolation between the first balanced port 2 and the second balanced port 3. One end of the transmission line 81 is connected to the first balanced port 2, and one end of the transmission line 82 is connected to the second balanced port 3. One end of the terminating resistor 83 is connected to an intermediate point between the other ends of the transmission lines 81 and 82, and the other end of the terminating resistor 83 is grounded. For impedance matching, the length of the transmission line 81 is adjusted to the quarter wavelength, and the impedance is adjusted to 70.7Ω. Likewise, the length of the transmission line 82 is adjusted to the quarter wavelength, and the impedance is adjusted to 70.7Ω.

The differential signals input from the first balanced port 2 and the second balanced port 3 are divided into the signals that propagate on the transmission lines 81 and 82, and the signals that propagate on the semi-rigid cables 71 and 72, respectively. In the isolation unit 80 (transmission lines 81, 82), the phase is changed at 180°. Meanwhile, in the balun 70 (semi-rigid cables 71, 72), the phase change is 0°. As a result, the signals are canceled with each other so that the signal input from the first balanced port 2 does not appear at the second balanced port 3. Likewise, the signal input from the second balanced port 3 does not appear at the first balanced port 2. Since the voltage becomes 0 V at a node 84, the terminating resistor 83 consumes no power.

If inputs from the first balanced port 2 and the second balanced port 3 are unequal or not in the reverse phase, or the input is only from one of those ports, the voltage no longer becomes 0 V at the node 84. The resultant voltage difference across the terminating resistor 83 causes unnecessary power to be absorbed by the terminating resistor 83 so that no signal appears at the other balanced port.

It is assumed that each impedance of the input terminals of the first balanced port 2 and the second balanced port 3 is designated as Ri, the impedance of the output terminal of the unbalanced port 1 is designated as Ro, each impedance of the semi-rigid cables 71, 72 is designated as B, each impedance of the transmission lines 81, 82 is designated as W, the terminating resistance is designated as T, and the center frequency is designated as fc.

Characteristics of the balun type combiner-divider 20 will be described referring to FIGS. 23A, 23B. FIG. 23A shows a result of simulating isolation characteristics of the balun type combiner-divider as shown in FIG. 22. FIG. 23B is a view showing a result of simulating reflection characteristics of the balun type combiner-divider as shown in FIG. 22.

The parameters for the simulating of the balun type combiner-divider 20 are set to be Ro=50Ω, Ri=50Ω, B=70.7Ω, W=70.7Ω, T=50Ω, and fc=1 GHz.

Figure 23A:
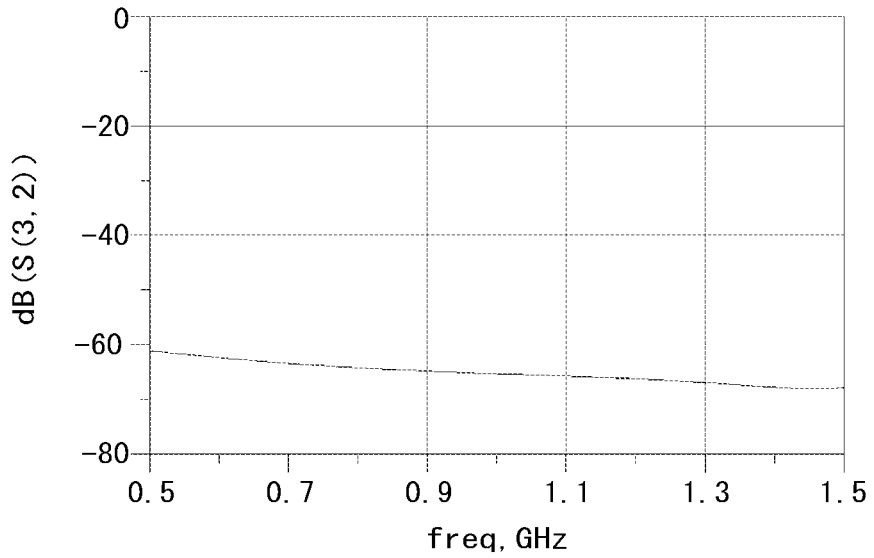
FIG. 23A is a view showing a result of simulating transmission characteristics of the balun type combiner as shown in FIG. 22.
Figure 23B:
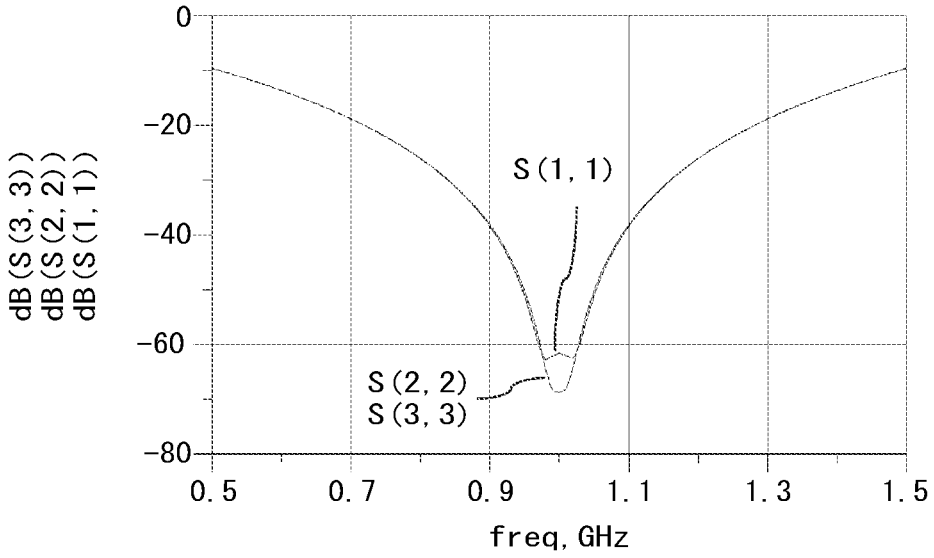
FIG. 23B is a view showing a result of simulating reflection characteristics and isolation characteristics of the balun type combiner as shown in FIG. 22.

As FIG. 23A shows, the isolation (S(3,2)) between the balanced ports is at the high level equal to or less than −60 dB, which establishes the impedance matching in the respective ports. Each of the reflection losses (S(2,2), S(3,3)) of the balanced ports is reduced to −60 dB or less at 1 GHz as shown in FIG. 23B.

The combiner-divider of Embodiment 2 is configured to have at least the following components. That is, the first component includes:

an unbalanced port;

a first balanced port;

a second balanced port;

baluns disposed between the unbalanced port and the first balanced port, and between the unbalanced port and the second balanced port, respectively; and an isolation unit disposed between the first balanced port and the second balanced port.

The balun includes:

a first semi-rigid cable having a core wire and a outer conductor; and a second semi-rigid cable having a core wire and a outer conductor.

One end of the core wire of the first semi-rigid cable is connected to the first balanced port. One end of the core wire of the second semi-rigid cable is connected to the second balanced port. The other end of the core wire of the first semi-rigid cable is connected to one end of the outer conductor of the second semi-rigid cable and the unbalanced port. The other end of the core wire of the second semi-rigid cable is connected to one end of the outer conductor of the first semi-rigid cable and a grounding wire.

The isolation unit includes:

a first transmission line;

a second transmission line; and a terminating resistor.

One ends of the first transmission line is connected to the first balanced port, and one end of the second transmission line is connected to the second balanced port. The other ends of the first and the second transmission lines are connected to one end of the terminating resistor. The other end of the terminating resistor is grounded.

Each line length of the first semi-rigid cable, the second semi-rigid cable, the first transmission line, and the second transmission line corresponds to ¼ wavelength at a center frequency.

In the second structure according to the first structure, each impedance of the unbalanced port, the first balanced port, the second balanced port, and the terminating resistor is 50Ω, and each impedance of the first semi-rigid cable, the second semi-rigid cable, the first transmission line, and the second transmission line is 70.7Ω.

The invention made by the inventors has been specifically described based on the embodiments, examples, and modified examples. It is to be understood that the present invention is not limited to the above-described embodiments, examples, and modified examples, but may be changed into various forms.

The semi-rigid cable is employed for the balun of the examples and the modified examples. It is possible to use the semi-flexible cable having external conductor reticulately weaved, and the pattern balun formed by the pattern on the wiring substrate.

INDUSTRIAL APPLICABILITY

The disclosure is applicable to the high power combiner-divider.

REFERENCE SIGNS LIST

10 . . . Wilkinson type combiner,
1 . . . first port (unbalanced port),
2 . . . second port (first balanced port),
3 . . . third port (second balanced port),
4, 5 . . . impedance converter,
6 . . . isolation resistor,
61 . . . balun,
62, 63 . . . semi-rigid cable,
64 . . . impedance converter,
65 . . . terminating resistor,
20 . . . balun type combiner-divider,
70 . . . balun,
71, 72 . . . semi-rigid cable,
80 . . . isolation unit,
81 . . . transmission line,
82 . . . transmission line,
83 . . . terminating resistor

The invention claimed is:

1. A combiner-divider comprising:

a first port;

a second port;

a third port;

a first impedance converter disposed between the first port and the second port;

a second impedance converter disposed between the first port and the third port; and an isolation unit disposed between the second port and the third port, wherein the isolation unit includes a balun formed of a first semi-rigid cable and a second semi-rigid cable, and terminating resistors, each one end of the terminating resistors is connected to the balun, and each of the other ends of the terminating resistors is grounded, each line length of the first impedance converter and the second impedance converter corresponds to ¼ wavelength at a center frequency, and a relationship of each impedance Ri of the second port and the third port, an impedance Ro of the first port, and each impedance W of the first impedance converter and the second impedance converter is expressed by W=(2□Ri□Ro)½.

2. The combiner-divider according to claim 1, wherein a relationship of an impedance T of the terminating resistor, and each impedance B of the first semi-rigid cable and the second semi-rigid cable is expressed by B/2=T/N, where N denotes an integer equal to or larger than 2.

3. The combiner-divider according to claim 2, wherein one end of a center conductor of the first semi-rigid cable is connected to the second port, one end of a center conductor of the second semi-rigid cable is connected to the third port, the other end of the center conductor of the first semi-rigid cable is connected to one end of an outer conductor of the second semi-rigid cable and the first port, and the other end of the center conductor of the second semi-rigid cable is connected to one end of an outer conductor of the first semi-rigid cable and a grounding wire.

4. The combiner-divider according to claim 1, wherein the isolation unit further includes a plurality of third impedance converters, each one end of the third impedance converters is connected to the balun, and each of the other ends of the third impedance converters is connected to one ends of the terminating resistors, respectively, and a relationship of each impedance I of the third impedance converters, an impedance T of the terminating resistor, and each impedance B of the first semi-rigid cable and the second semi-rigid cable is expressed by I=(B□T□N/2)½, where N denotes an integer equal to or larger than 2.

5. The combiner-divider according to claim 4, wherein one end of a center conductor of the first semi-rigid cable is connected to the second port, one end of a center conductor of the second semi-rigid cable is connected to the third port, the other end of the center conductor of the first semi-rigid cable is connected to one end of an outer conductor of the second semi-rigid cable and the first port, and the other end of the center conductor of the second semi-rigid cable is connected to one end of an outer conductor of the first semi-rigid cable and a grounding wire.

6. The combiner-divider according to claim 1, wherein the isolation unit further includes a third impedance converter, one end of the third impedance converter is connected to the balun, and the other end of the third impedance converter is connected to each one end of the terminating resistors, respectively, and a relationship of an impedance I of the third impedance converter, an impedance T of the terminating resistor, and each impedance B of the first semi-rigid cable and the second semi-rigid cable is expressed by I=(B□T/(2□N))½, where N denotes an integer equal to or larger than 2.

7. The combiner-divider according to claim 6, wherein one end of a center conductor of the first semi-rigid cable is connected to the second port, one end of a center conductor of the second semi-rigid cable is connected to the third port, the other end of the center conductor of the first semi-rigid cable is connected to one end of an outer conductor of the second semi-rigid cable and the first port, and the other end of the center conductor of the second semi-rigid cable is connected to one end of an outer conductor of the first semi-rigid cable and a grounding wire.

8. The combiner-divider according to claim 1, wherein one end of a center conductor of the first semi-rigid cable is connected to the second port, one end of a center conductor of the second semi-rigid cable is connected to the third port, the other end of the center conductor of the first semi-rigid cable is connected to one end of an outer conductor of the second semi-rigid cable and the first port, and the other end of the center conductor of the second semi-rigid cable is connected to one end of an outer conductor of the first semi-rigid cable and a grounding wire.

* * * * *